US012344967B2

(12) United States Patent
Ueda

(10) Patent No.: US 12,344,967 B2
(45) Date of Patent: Jul. 1, 2025

(54) INDUSTRIAL FABRIC

(71) Applicant: NIPPON FILCON CO., LTD., Tokyo (JP)

(72) Inventor: Ikuo Ueda, Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 0 days.

(21) Appl. No.: 18/415,997

(22) Filed: Jan. 18, 2024

(65) Prior Publication Data

US 2024/0158961 A1 May 16, 2024

Related U.S. Application Data

(63) Continuation of application No. PCT/JP2022/011459, filed on Mar. 15, 2022.

(30) Foreign Application Priority Data

Jul. 21, 2021 (JP) ..... 2021-120829

(51) Int. Cl.
*D03D 11/00* (2006.01)
*D03D 1/00* (2006.01)
(Continued)

(52) U.S. Cl.
CPC ..... *D03D 13/006* (2013.01); *D03D 1/00* (2013.01); *D10B 2505/00* (2013.01)

(58) Field of Classification Search
CPC .... D03D 13/006; D03D 1/00; D10B 2505/00; D21F 1/0045
See application file for complete search history.

(56) References Cited

U.S. PATENT DOCUMENTS 5,544,678 A * 8/1996 Barrett ..... D21F 1/0045 139/383 A
6,284,678 B1 * 9/2001 Kobayashi ..... D03D 11/00 139/411
(Continued)

FOREIGN PATENT DOCUMENTS

CA 2 352 898 A1 10/2001
JP H62-78294 A 4/1987
(Continued)

OTHER PUBLICATIONS

Supplementary Search Report issued in European Application No. 22845624.0, mailed Nov. 14, 2024.
(Continued)

*Primary Examiner* — Robert H Muromoto, Jr.
(74) *Attorney, Agent, or Firm* — Michael Best & Friedrich LLP

(57) ABSTRACT

Each of upper surface side warps arranged vertically with lower surface side warps in pairs has a common weaving pattern excluding binding wefts. Binding warps constitute at least one of two warps vertically arranged forming pairs. In the pairs formed by the binding warps and the warps arranged vertically with the binding warps, the warps complement each other to form a weaving pattern for one upper surface side warp and a weaving pattern for one lower surface side warp, respectively, The upper surface side warps and the binding warps are interwoven with the upper surface side wefts to form an upper surface side fabric formed in a predetermined weaving pattern for each warp row. The lower surface side warps and the binding warps are interwoven with the lower surface side wefts to form a lower surface side fabric formed in a predetermined weaving pattern for each warp row.

11 Claims, 18 Drawing Sheets

(51) Int. Cl.
*D03D 13/00* (2006.01)
*D21F 7/08* (2006.01)

(56) References Cited

U.S. PATENT DOCUMENTS

| | | | | |
|---|---|---|---|---|
| 7,059,357 | B2 * | 6/2006 | Ward | D21F 1/0045 442/205 |
| 7,415,993 | B2 * | 8/2008 | Hay | D21F 1/0036 162/900 |
| 7,484,537 | B2 * | 2/2009 | Ueda | D21F 1/0036 139/383 A |
| 7,878,224 | B2 * | 2/2011 | Quigley | D21F 1/0045 139/383 R |
| 7,882,857 | B1 * | 2/2011 | Ueda | D21F 1/0036 139/383 R |
| 8,991,440 | B2 | 3/2015 | Ueda et al. | |
| 9,359,699 | B2 * | 6/2016 | Hashiguchi | D03D 11/00 |
| 10,329,714 | B2 * | 6/2019 | Chaplin | D03D 11/00 |
| 2010/0221499 | A1 | 9/2010 | Ueda et al. | |
| 2010/0236741 | A1 | 9/2010 | Hack-Ueberall | |
| 2023/0160110 | A1 * | 5/2023 | Fujisawa | D03D 13/004 442/203 |

FOREIGN PATENT DOCUMENTS

| | | | |
|---|---|---|---|
| JP | 2002-235258 | A | 8/2002 |
| JP | 2003-155680 | A | 5/2003 |
| JP | 2003-239188 | A | 8/2003 |
| JP | 2003-342889 | A | 12/2003 |
| JP | 2004-052188 | A | 2/2004 |
| JP | 2006-057215 | A | 3/2006 |
| JP | 2006-152462 | A | 6/2006 |
| JP | 2013-513732 | A | 4/2013 |

OTHER PUBLICATIONS

International Search Report issued in Application No. PCT/JP2022/011459, mailed May 24, 2022.
International Preliminary Report on Patentability issued in PCT Appplication No. PCT/JP2022/011459, issued Jan. 18, 2024.
Extended Search Report issued in European Application No. 22845624.0-1015, mailed Mar. 25, 2025.
Office Action issued in Japanese Application No. 2024-107733, dated May 27, 2025.

* cited by examiner

50

60

INDUSTRIAL FABRIC

1. FIELD OF THE INVENTION

The present invention relates to industrial fabrics used for paper machines.

2. DESCRIPTION OF THE RELATED ART

In the related art, papermaking meshes made of warps and wefts have been widely used as industrial fabrics for paper machines. The characteristics required for the papermaking meshes vary. For example, Patent Literature 1 discloses an industrial fabric that includes: an upper layer surface side fabric including upper layer surface side warps and upper layer surface side wefts; a lower layer surface side fabric including lower layer surface side warps and lower layer surface side wefts; upper layer surface side warps functioning as binding yarns; and lower layer surface side warps functioning as binding yarns. The upper layer surface side warps functioning as binding yarns and the lower layer surface side warps functioning as binding yarns are provided in pairs at the top and bottom.

PATENT LITERATURE 1: JP 2003-342889

By increasing binding yarns, the bonding force for binding the upper and lower side fabrics can be increased. However, there is a risk of causing a decrease in the surface properties and a decrease in the air permeability when only warp binding yarns are increased.

SUMMARY OF THE INVENTION

A purpose of the present invention is to provide industrial fabrics that suppress a decrease in the surface properties and a decrease in the air permeability while ensuring the binding force.

Solution to Problem

One embodiment of the present invention relates to an industrial fabric in which an upper surface side fabric and a lower surface side fabric are bound, wherein the upper surface side fabric and the lower surface side fabric are formed by interweaving warps and wefts. The wefts include: binding wefts that bind the upper surface side fabric and the lower surface side fabric; upper surface side wefts that form a part of the upper surface side fabric; and lower surface side wefts that form a part of the lower surface side fabric. The warps include: binding warps that bind the upper surface side fabric and the lower surface side fabric; upper surface side warps that are interwoven with the upper surface side wefts without being interwoven with the lower surface side wefts so as to form a part of the upper surface side fabric; and lower surface side warps that are interwoven with the lower surface side wefts without being interwoven with the upper surface side wefts so as to form a part of the lower surface side fabric. Each of upper surface side warps arranged vertically with lower surface side warps so as to form pairs has a common weaving pattern excluding binding wefts. Binding warps constitute at least one of two of the warps vertically arranged forming pairs. In the pairs formed by the binding warps and the warps arranged vertically with the binding warps, the binding warps and the warps complement each other so as to form a weaving pattern for one upper surface side warp and a weaving pattern for one lower surface side warp, respectively. The upper surface side warps and the binding warps are interwoven with the upper surface side wefts so as to form an upper surface side fabric formed in a predetermined weaving pattern for each warp row. The lower surface side warps and the binding warps are interwoven with the lower surface side wefts so as to form a lower surface side fabric formed in a predetermined weaving pattern for each warp row. The binding wefts form knuckles that pass above two or less of the upper surface side warps consecutively and are not adjacent to one another in the warp direction.

Another embodiment of the present invention also relates to an industrial fabric in which an upper surface side fabric and a lower surface side fabric are bound. In this industrial fabric, the upper surface side fabric and the lower surface side fabric are formed by interweaving warps and wefts. The wefts include: binding wefts that bind the upper surface side fabric and the lower surface side fabric; upper surface side wefts that form a part of the upper surface side fabric; and lower surface side wefts that form a part of the lower surface side fabric. The warps include: binding warps that bind the upper surface side fabric and the lower surface side fabric; upper surface side warps that are interwoven with the upper surface side wefts without being interwoven with the lower surface side wefts so as to form a part of the upper surface side fabric; and lower surface side warps that are interwoven with the lower surface side wefts without being interwoven with the upper surface side wefts so as to form a part of the lower surface side fabric. Binding warps constitute at least one of two of the warps vertically arranged forming pairs. In the pairs formed by the binding warps and the warps arranged vertically with the binding warps, the binding warps and the warps complement each other so as to form a weaving pattern for one upper surface side warp and a weaving pattern for one lower surface side warp, respectively. The upper surface side warps and the binding warps are interwoven with the upper surface side wefts and the binding wefts so as to form an upper surface side fabric formed in a predetermined weaving pattern for each warp row. The lower surface side warps and the binding warps are interwoven with the lower surface side wefts so as to form a lower surface side fabric formed in a predetermined weaving pattern for each warp row. The binding wefts have a first binding weft and a second binding weft that are arranged being adjacent to each other in a pair. In the pair formed by the first binding weft and the second binding weft that are adjacent to each other, the first binding weft and the second binding weft complement each other so as to form a weaving pattern for one upper surface side weft on a obverse surface of the upper surface side fabric. The first binding weft and the second binding weft each form knuckles that pass above two or less of the upper surface side warps consecutively.

BRIEF DESCRIPTION OF THE DRAWINGS

According to the present invention, industrial fabrics can be provided that suppress a decrease in the surface properties and a decrease in the air permeability while ensuring the binding force.

DETAILED DESCRIPTION OF THE INVENTION

In the following explanation, "warps" are threads extending along the direction of web conveyance, and "wefts" are threads extending in a direction that intersects the warps, when a multi-layered fabric for papermaking constitutes a looped belt. The "upper surface side fabric" is a fabric located on the obverse surface side where the web is conveyed out of the two sides of a papermaking mesh when a multi-layered fabric is used as the papermaking mesh, and the "lower surface side fabric" is a fabric located mainly on the reverse surface side where a drive roller is in contact out of the two sides of a papermaking belt. The "obverse surface" simply means a surface on the side where the upper surface side fabric or the lower surface side fabric is exposed. While the "obverse surface" of the upper surface side fabric corresponds to the obverse surface side of a papermaking mesh, the "obverse surface" of the lower surface side fabric corresponds to the reverse surface side of the papermaking mesh.

Further, the term "design diagram" represents the minimum repeating unit of a textile texture and corresponds to a weave repeat of the textile. In other words, the term "weave repeat" is repeated from front to back and left to right to form a "textile". Further, "knuckle" refers to a part where a warp is exposed on the obverse surface after passing above or below a single or multiple wefts.

Further, "binding warps" means at least some of warps that make up the upper surface side fabric (or lower surface side fabric) and are yarns that bind the upper surface side fabric with the lower surface side fabric by the weaving of a weft of the lower surface side fabric (or the upper surface side fabric) from the reverse surface side (or the obverse surface side) with a warp that should normally be woven with only a weft of the upper surface side fabric (or the lower surface side fabric). Further, "binding wefts" means at least some of wefts that make up the upper surface side fabric and the lower surface side fabric and are yarns that bind the upper surface side fabric with the lower surface side fabric by the weaving of a warp of the lower surface side fabric (or the upper surface side fabric) from the reverse surface side (or the obverse surface side) with a weft that should normally be interwoven only with a warp of the upper surface side fabric (or the lower surface side fabric).

First Embodiment

Figure 1:
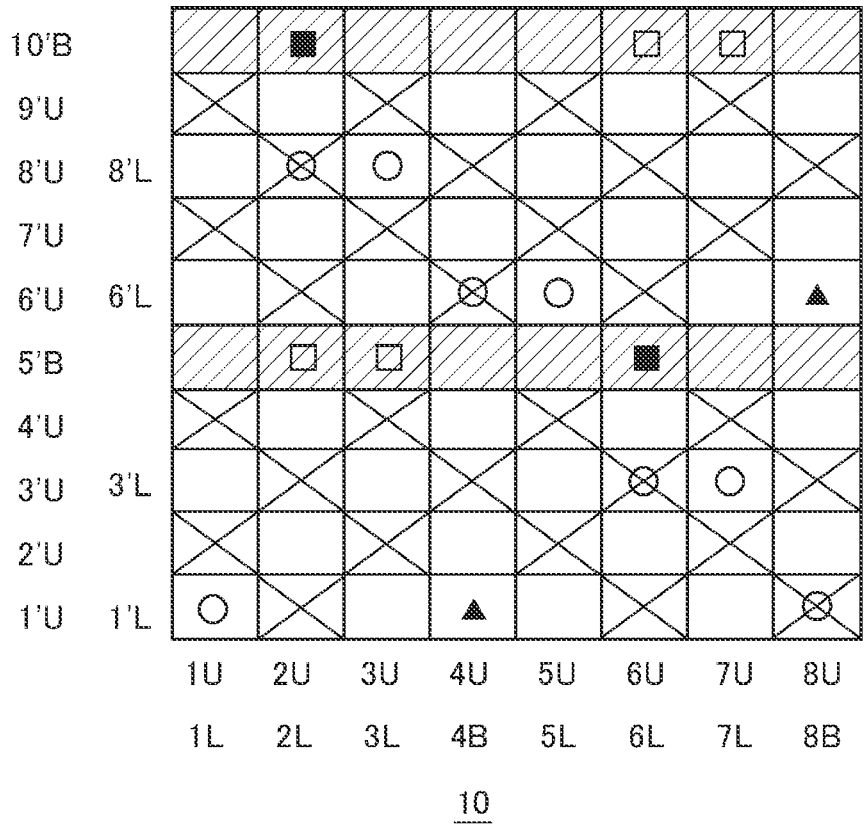
FIG. 1 is a design diagram showing a weave repeat of an industrial fabric according to the first embodiment.

FIG. 1 is a design diagram showing a weave repeat of an industrial fabric 10 according to the first embodiment. FIG. 2 is a cross-sectional view in the warp direction along warps in the design diagram shown in FIG. 1. FIG. 3 is a cross-sectional view in the weft direction along wefts in the design diagram shown in FIG. 1.

In the design diagrams, warps are represented by Arabic numerals, for example, 1, 2, 3, and so on. Wefts are represented by Arabic numerals with a dash, for example, 1', 2', 3', and so on. Upper surface side yarns are denoted by numbers with "U", and lower surface side yarns are denoted by numbers with "L", e.g., 1'U, 2'L, etc. Binding warps binding the upper surface side fabric and the lower surface side fabric are denoted by numbers with "B," and a first binding warp and a second binding warp are denoted as Bf and Bs, respectively. Binding wefts binding the upper surface side fabric and the lower surface side fabric are also denoted by numbers with "B," and a first binding weft and a second binding weft are denoted as Bf and Bs, respectively.

In the design diagrams, ▲ marks indicate that first binding warps are arranged below lower surface side wefts, ▲ marks indicate that second binding warps are arranged above upper surface side wefts, x marks indicate that upper surface side warps and the first binding warps are arranged above the upper surface side wefts, ○ marks indicate that lower surface side warps and the second binding warps are arranged below the lower surface side wefts, □ marks indicate that binding wefts are arranged below lower surface side warps or binding warps, and ■ marks indicate that binding wefts are arranged above upper surface side warps or binding warps. The Δ marks, the ▲ marks, the x marks, the ○ marks, the □ marks, and the ■ marks indicate knuckles. These notations are used in the same manner in FIG. 4 and subsequent figures.

In the industrial fabric 10 according to the first embodiment shown in FIG. 1, an upper surface side fabric formed including upper surface side warps (1U to 8U) and upper surface side wefts (1'U to 4'U and 6'U to 9'U) and a lower surface side fabric formed including lower surface side warps (1L to 3L and 5L to 7L) and lower surface side wefts (1'L, 3'L, 6'L, and 8'L) are bound to each other by binding warps (4B and 8B) and binding wefts (5'B and 10'B).

The upper surface side wefts (1'U to 4'U and 6'U to 9'U) form a part of the upper surface side fabric. The lower surface side wefts (1'L, 3'L, 6'L, and 8'L) form a part of the lower surface side fabric. The binding warps (4B and 8B) bind the upper surface side fabric and the lower surface side fabric and each form a part of the upper surface side fabric and a part of the lower surface side fabric. Although the binding wefts (5'B and 10'B) bind the upper surface side fabric and the lower surface side fabric, the binding wefts are not included in a weaving pattern of the upper surface side fabric and the lower surface side fabric.

The weaving method of each warp and each weft in the industrial fabric 10 will be explained next with reference to FIGS. 2A and 2B and FIGS. 3A and 3B. The upper surface side wefts, the lower surface side wefts, and the binding wefts shown in FIGS. 2A and 2B are arranged in the same manner.

Figure 2A:
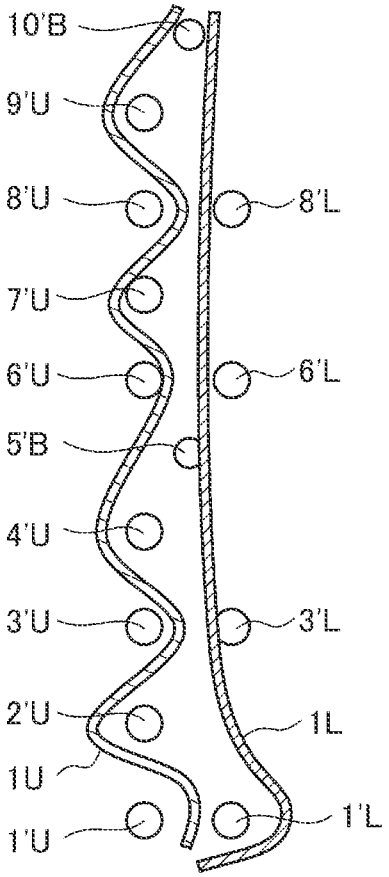
FIG. 2 is a cross-sectional view in the warp direction along warps in the design diagram shown in FIG. 1.
Figure 2B:
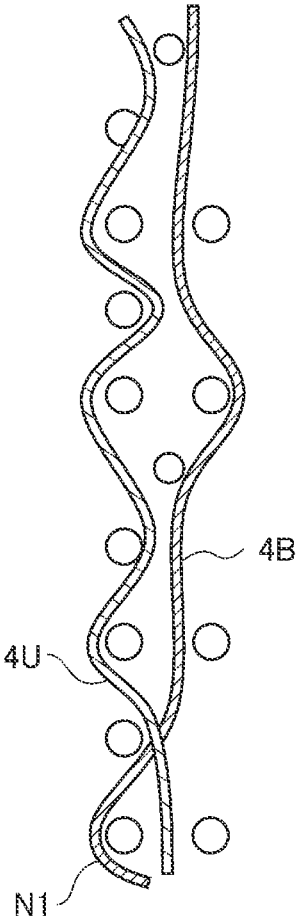

FIG. 2A shows a form in which a pair formed by the upper surface side warp 1U and the lower surface side warp 1L is interwoven with the upper and lower surface side wefts and the binding wefts. As shown in FIG. 2A, the upper surface side warp 1U is woven above and below the upper surface side wefts (1'U to 4'U and 6'U to 9'U) alternately one by one, passes above the upper surface side wefts (2'U, 4'U, 7'U, and 9'U) so as to form knuckles, respectively, and passes below the upper surface side wefts (1'U, 3'U, 6'U, and 8'U). Further, although the binding wefts are not included in a weaving pattern in which the upper surface side warp 1U is woven above and below the upper surface side wefts alternately one by one, the upper surface side warp 1U passes above the binding wefts (5'B and 10'B).

The upper surface side warps (3U, 5U, and 7U) is interwoven with the upper surface side wefts (1'U to 4'U and 6'U to 9'U) in the same manner as the upper surface side warp 1U. The upper surface side warps (2U and 6U) are each woven above and below the upper surface side wefts (1'U to 4'U and 6'U to 9'U) alternately one by one in the same manner as the upper surface side warp 1U except that the interweaving position is shifted by one in the warp direction compared to the upper surface side warp 1U. As described, the upper surface side warps (1U to 3U and 5U to 7U) have the same weaving pattern, form knuckles at constant intervals with respect to the upper surface side wefts (1'U to 4'U and 6'U to 9'U), and are woven alternately without destroying the obverse surface texture. The upper surface side warps (1U to 3U and 5U to 7U) are not interwoven with the lower surface side wefts (1'L, 3'L, 6'L, and 8'L) but are interwoven only with the upper surface side wefts (1'U to 4'U and 6'U to 9'U) and the binding wefts (5'B and 10'B) so as to form a part of the upper surface side fabric.

The lower surface side warp 1L passes below the lower surface side weft 1'L so as to form a knuckle and passes above the three lower surface side wefts (3'L, 6'L, and 8'L). Further, although the binding wefts are not included in a weaving pattern in which the lower surface side warp 1L passes below one lower surface side weft and above three lower surface side wefts, the lower surface side warp 1L passes below the binding wefts (5'B and 10'B). Although the lower surface side warps (2L, 3L, and 5L to 7L) include those whose weaving position is shifted in the warp direction from that of the lower surface side warp 1L, the lower surface side warps have the same weaving pattern as that of the lower surface side warp 1L and are woven passing below one lower surface side weft and above three lower surface side wefts. As described, the lower surface side warps (1L to 3L and 5L to 7L) are not interwoven with the upper surface side wefts (1'U to 4'U and 6'U to 9'U) but are interwoven only with the lower surface side wefts (1'L, 3'L, 6'L, and 8'L) and the binding wefts (5'B and 10'B) so as to form a part of the lower surface side fabric.

The upper surface side warps (1U to 3U and 5U to 7U) have a common weaving pattern except for the binding wefts (5'B and 10'B). That is, the upper surface side warps (1U to 3U and 5U to 7U) each have a weaving pattern in which the upper surface side warps are each woven above and below the upper surface side wefts (1'U to 4'U and 6'U to 9'U) alternately one by one, except for the binding wefts (5'B and 10'B).

Further, the lower surface side warps (1L to 3L and 5L to 7L) also have a common weaving pattern except for the binding wefts (5'B and 10'B) and have a weaving pattern in which the lower surface side warps are interwoven with the lower surface side wefts (1'L, 3'L, 6'L, and 8'L) while passing below one of the lower surface side wefts and above three of the lower surface side wefts. As described, the binding wefts (5'B and 10'B) are not included in a weaving pattern of the upper surface side fabric and the lower surface side fabric.

FIG. 2B shows a form in which a pair formed by the upper surface side warp 4U and the binding warp 4B is interwoven with the upper and lower surface side wefts and the binding wefts. The upper surface side warp 4U and the binding warp 4B form a pair facing each other vertically and intersect with each other due to the binding by the binding warp 4B.

The upper surface side warp 4U passes above the upper surface side wefts (3'U, 6'U, and 8'U) so as to form knuckles, respectively, and passes below the upper surface side wefts (1'U, 2'U, 4'U, 7'U, and 9'U). The upper surface side warp 4U passes above the binding wefts (5'B and 10'B).

The binding warp 4B passes below the lower surface side weft 6'L so as to form a knuckle and forms a knuckle N1 passing above the upper surface side weft 1'U. With respect to the lower surface side wefts (1'L, 3'L, 6'L, and 8'L), the binding warp 4B passes below one lower surface side weft and above three lower surface side wefts so as to form knuckles at constant intervals on the lower surface side fabric and is interwoven without destroying the reverse surface texture. The binding warp 4B passes below the binding wefts (5'B and 10'B).

For the upper surface side fabric, the binding warp 4B passes above the upper surface side weft 1'U for binding so as to form only one knuckle N1 on the obverse surface side and passes below the upper surface side wefts (2'U to 4'U, and 6'U to 9'U).

The pair formed by the upper surface side warp 4U and the binding warp 4B has a common weaving pattern with the upper surface side warps (1U to 3U and 5U to 7U) and the lower surface side warps (1L to 3L and 5L to 7L) except for the binding wefts (5'B and 10'B). That is, the pair formed by the upper surface side warp 4U and the binding warp 4B has a weaving pattern of being interwoven with the upper surface side wefts (1'U to 4'U and 6'U to 9'U) in which the pair is woven above and below the upper surface side wefts alternately one by one except for the binding wefts (5'B and 10'B) and has a weaving pattern of being interwoven with the lower surface side wefts (1'L, 3'L, 6'L, and 8'L) in which the pair is woven passing below one of the lower surface side wefts and above three of the lower surface side wefts. Although the weaving position is shifted in the warp direction, the pair formed by the upper surface side warp 8U and the binding warp 8B has the same weaving pattern as that of the pair formed by the upper surface side warp 4U and the binding warp 4B and exhibits the same function.

At the position where the binding warp 4B forms a knuckle N1 on the obverse surface side, the upper surface side warp 4U does not form a knuckle on the obverse surface side after passing below the upper surface side weft 1'U and acts as an upper surface side collapsing yarn 4U that collapses a part of the upper surface side obverse surface texture.

The upper surface side warp 4U and the binding warp 4B complement each other in the obverse surface texture of the upper surface side fabric, thereby forming the same obverse surface texture as that of the upper surface side warps (1U to 3U and 5U to 7U) other than the upper surface side warp 4U (upper surface side collapsing yarn) and forming the same number of knuckles as the number of the upper surface side warps (1U to 3U and 5U to 7U) other than the upper surface side collapsing yarn 4U in the upper surface side obverse surface texture. As described, in the pair formed by the upper surface side warp 4U and the binding warp 4B, the warps complement each other so as to form a weaving pattern for one upper surface side warp and a weaving pattern for one lower surface side warp, respectively. The weaving pattern of the upper surface side warp 4U and the binding warp 4B does not include the binding wefts (5'B and 10'B). This prevents the binding warp 4B from lowering the surface properties of the upper surface side fabric. Further, by using a pair formed by the upper surface side collapsing yarn 4U and the binding warp 4B for the binding, a decrease in the surface properties can be suppressed compared to a case where binding warps are vertically provided.

The upper surface side warps (1U to 8U) and the binding warps (4B and 8B) are interwoven with the upper surface side wefts (1'U to 4'U and 6'U to 9'U) so as to form an upper surface side fabric formed in a predetermined weaving pattern for each warp row. In other words, the upper surface side warps (1U to 8U) and the binding warps (4B and 8B) form knuckles that are separated at constant intervals on the upper surface side fabric. This allows for suppression of a decrease in the surface properties of the upper surface side fabric.

The lower surface side warps (1L to 3L and 5L to 7L) and the binding warps (4B and 8B) are interwoven with the lower surface side wefts (1'L, 3'L, 6'L, and 8'L) so as to form a lower surface side fabric formed in a predetermined weaving pattern for each warp row. In other words, the lower surface side warps (1L to 3L and 5L to 7L) and the binding warps (4B and 8B) form knuckles that are separated at constant intervals on the lower surface side fabric. This allows for suppression of a decrease in the surface properties of the lower surface side fabric.

The upper surface side warps (1U to 8U) and the binding warps (4B and 8B) are formed with the same diameter but may be formed with different diameters in another embodiment. Since the binding warps (4B and 8B) also appear on the obverse surface on the upper surface side, a decrease in the surface properties can be suppressed by making the diameter the same as that of the upper surface side warps (1U to 8U). The diameter of the lower surface side warps may be larger than the diameter of the upper surface side warps. By setting the diameter of the lower surface side warps to be larger than the diameter of the upper surface side warps, the rigidity and warp-direction elongation characteristics of the industrial fabric 10 can be improved.

Figure 3A:
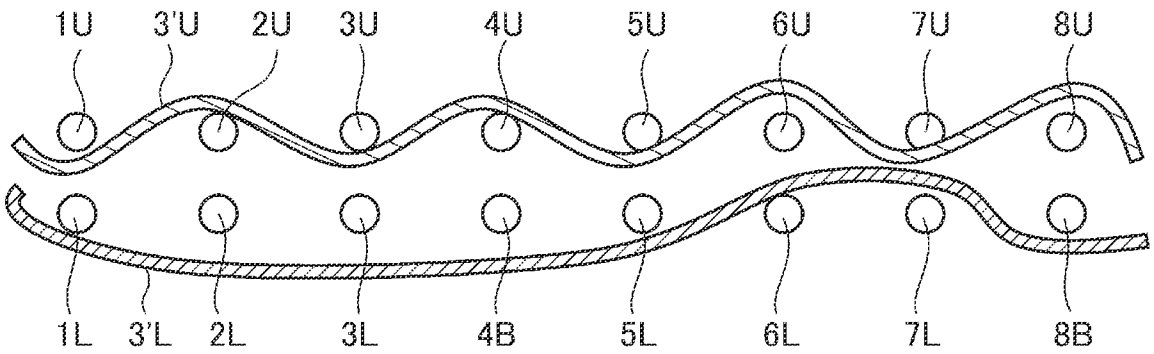
FIG. 3 is a cross-sectional view in the weft direction along wefts in the design diagram shown in FIG. 1.

FIG. 3A shows a form in which a pair formed by the upper surface side weft 3'U and the lower surface side weft 3'L is interwoven with the upper and lower surface side warps and the binding warps. As shown in FIG. 3A, the upper surface side weft 3'U is woven above and below the upper surface side warps (1U to 8U) alternately one by one, passes above the upper surface side warps (2U, 4U, 6U, and 8U) so as to form knuckles, respectively, and passes below the upper surface side warps (1U, 3U, 5U, and 7U). The upper surface side wefts (2'U, 4'U, and 7'U to 9'U) have the same weaving pattern as that of the upper surface side weft 3'U and are each woven above and below the upper surface side warps (1U to 8U) alternately one by one. Further, although the upper surface side wefts (1'U and 6'U) have the same weaving pattern as that of the upper surface side weft 3'U, the weaving target with which the upper surface side wefts are to be interwoven includes the upper surface side warps (1U to 8U) and binding warps.

The lower surface side weft 3'L passes below six warps (1L to 3L, 4B, 5L, and 8B) located on the lower surface side so as to form a long knuckle and passes above two lower surface side warps (6L and 7L). The warps located on the lower surface side include not only the lower surface side warps (1L to 3L and 5L to 7L) but also the binding warps (4B and 8B). Although the lower surface side wefts (1'L, 6'L, and 8'L) include those whose weaving position is shifted in the weft direction from that of the lower surface side weft 3'L, the lower surface side wefts have the same weaving pattern as that of the lower surface side weft 3'L, pass below six warps located on the lower surface side so as to form a long knuckle, and pass above two warps located on the lower surface side.

Figure 3B:
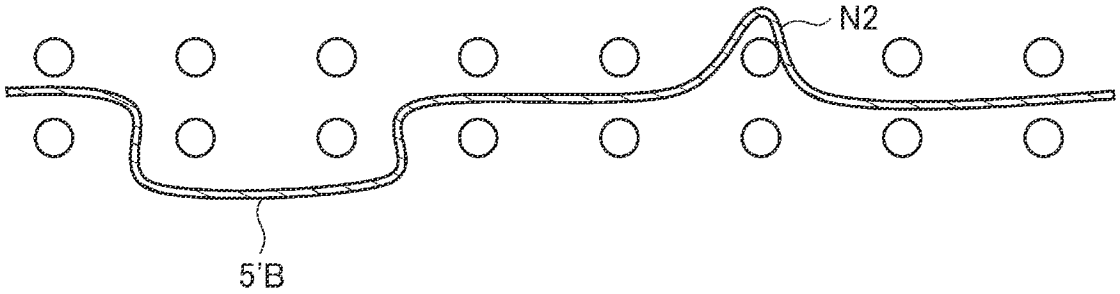

FIG. 3B shows a form in which the binding weft 5'B is interwoven with upper surface side warps and lower surface side warps. The binding weft 5'B passes above six warps (1L, 4B, 5L to 7L, and 8B) located on the lower surface side and passes below two warps (2L and 3L) located on the lower surface side so as to form knuckles. The binding weft 5'B passes above the upper surface side warp 6U so as to form knuckles and passes below the other upper surface side warps (1U to 5U, 7U, and 8U). That is, the binding weft 5'B forms one knuckle on the upper surface side obverse surface texture and one knuckle on the lower surface side obverse surface texture.

The binding weft 5'B forms a knuckle N2 that passes above two or less upper surface side warps 6U out of the upper surface side warps (1U to 8U). In other words, the binding weft 5'B does not form knuckles that pass consecutively above three or more upper surface side warps out of the upper surface side warps (1U to 8U). The knuckle N2 formed on the upper surface side by the binding weft 5'B passes above one upper surface side warp 6U. Thereby, the durability of the binding weft 5'B can be improved by reducing the part of the binding weft 5'B that is exposed on the obverse surface on the upper surface side, and damage to the binding weft 5'B caused by a high-pressure washing shower or the like installed in a paper machine can be suppressed. Further, by reducing the part of the binding weft 5'B that is exposed on the obverse surface on the reverse surface side, it is possible to suppress the wear of the binding yarn caused due to a drive roll, etc., or the suction box of the paper machine. Further, the binding warp 5'B forms knuckles that pass below two or less warps (2L and 3L) located on the lower surface side out of the lower surface side warps and the binding warps, that is, the warps (1L to 3L, 4B, 5L to 7L, and 8B) located on the lower surface side. Thereby, the part of the binding weft 5'B that is exposed on the obverse surface on the lower surface side can be reduced. Although the weaving position is shifted in the weft direction compared to that of the binding weft 5'B, the binding weft 10'B has the same weaving pattern and exhibits the same function.

The industrial fabric 10 is bound by the binding wefts (5'B and 10'B) arranged apart in the warp direction and a pair formed by the binding warps (4B and 8B) and the upper surface side warps. Thus, the industrial fabric 10 can be bound with an appropriate binding force that can suppress internal wear of the upper surface side fabric and the lower surface side fabric. In addition to binding with the binding warps, binding with binding wefts that are not incorporated into the weaving pattern allows for the setting of an appropriate binding force compared to simply increasing the number of binding warps and thus allows for the suppression of a decrease in the surface properties and the air permeability.

The binding wefts (5'B and 10'B) are arranged such that the binding wefts are not adjacent in the warp direction. This allows the binding positions to be dispersed, dehydration inhibition due to binding to be suppressed, and air permeability to be improved.

The diameter of the binding wefts (5'B and 10'B) is smaller than the diameter of the lower surface side wefts (1'L, 3'L, 6'L, and 8'L) and is set to half the size or less, for example. Thereby, even if the binding wefts (5'B and 10'B) are not included in a predetermined weaving pattern of each warp, deviations in the predetermined weaving pattern can be suppressed.

Further, the binding wefts (5'B and 10'B) are formed so as to be less exposed to the obverse surface compared to the lower side wefts (1'L, 3'L, 6'L, and 8'L). While the binding wefts (5'B and 10'B) pass below two warps out of the warps (1L, 4B, 5L to 7L, and 8B) located on the lower surface side so as to be exposed on the obverse surface on the lower surface side, the lower surface side wefts (1'L, 3'L, 6'L, and 8'L) pass below six warps out of the warps (1L, 4B, 5L to 7L, and 8B) located on the lower surface side so as to be exposed on the obverse surface on the lower surface side. Thereby, the wear of the binding wefts (5'B and 10'B) having a small diameter can be suppressed.

The number of all the warps (1U to 8U, 1L to 3L, 4B, 5L to 7L, and 8B) forming the weave repeat is a multiple of four. This makes it possible to work for weaving methods such as plain weave, twill weave, 2/2 weave where two threads are woven alternately, 1/2 weave, and 1/4 weave.

Second Embodiment

Figure 4:
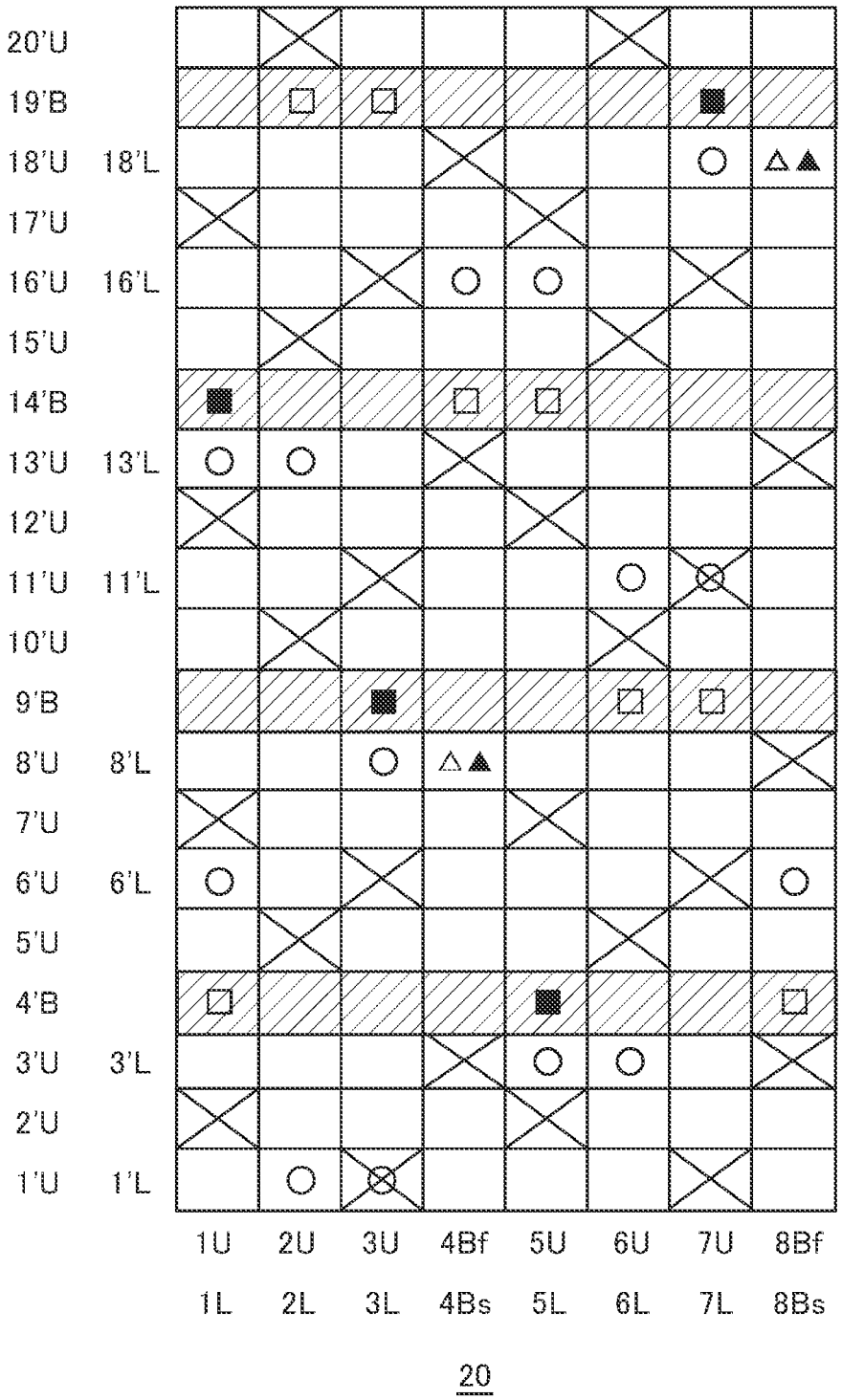
FIG. 4 is a design diagram showing a weave repeat of an industrial fabric according to the second embodiment.

FIG. 4 is a design diagram showing a weave repeat of an industrial fabric 20 according to the second embodiment. FIG. 5 is a cross-sectional view in the warp direction along warps in the design diagram shown in FIG. 4. FIG. 6 is a cross-sectional view in the weft direction along wefts in the design diagram shown in FIG. 4.

In an industrial fabric 20 according to the second embodiment shown in FIG. 4, an upper surface side fabric formed including upper surface side warps (1U to 3U and 5U to 7U) and upper surface side wefts (1'U to 3'U, 5'U to 8'U, 10'U to 13'U, 15'U to 18'U, and 20'U) and a lower surface side fabric formed including lower surface side warps (1L to 3L and 5L to 7L) and lower surface side wefts (1'L, 3'L, 6'L, 8'L, 11'L, 13'L, 16'L, and 18'L) are bound to each other by the first binding warps (4Bf and 8Bf), the second binding warps (4Bs and 8Bs), and the third binding wefts (4'B, 9'B, 14'B, and 19'B). The first binding warps (4Bf and 8Bf) and the second binding warps (4Bs and 8Bs) are simply referred to as binding warps when the binding warps are not to be distinguished.

The upper surface side wefts (1'U to 3'U, 5'U to 8'U, 10'U to 13'U, 15'U to 18'U, and 20'U) form a part of the upper surface side fabric. The lower surface side wefts (1'L, 3'L, 6'L, 8'L, 11'L, 13'L, 16'L, and 18'L) form a part of the lower surface side fabric. The binding warps (4Bf, 4Bs, 8Bf, and 8Bs) bind the upper surface side fabric and the lower surface side fabric and each form a part of the upper surface side fabric and a part of the lower surface side fabric. Although the binding wefts (4'B, 9'B, 14'B, and 19'B) bind the upper surface side fabric and the lower surface side fabric, the binding wefts are not included in a weaving pattern of the upper surface side fabric and the lower surface side fabric.

Figure 5A:
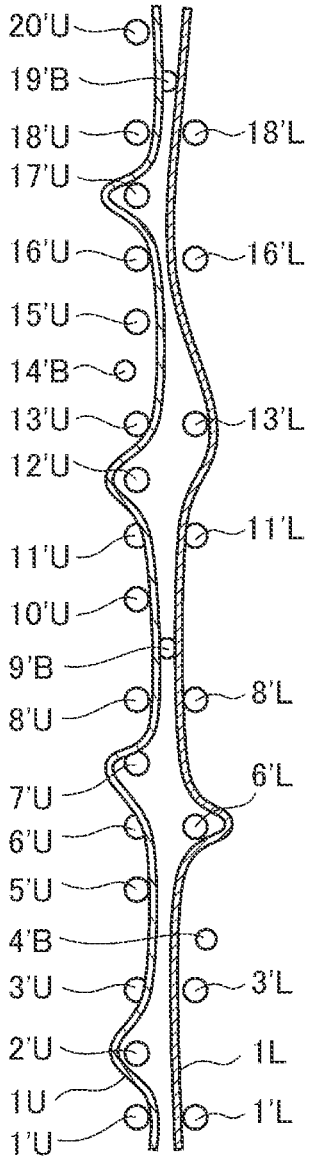
FIG. 5 is a cross-sectional view in the warp direction along warps in the design diagram shown in FIG. 4.

FIG. 5A shows a form in which a pair formed by the upper surface side warp 1U and the lower surface side warp 1L is interwoven with the upper and lower surface side wefts and the binding wefts. As shown in FIG. 5A, the upper surface side warp 1U is interwoven with the upper surface side wefts (1'U to 3'U, 5'U to 8'U, 10'U to 13'U, 15'U to 18'U, and 20'U) while passing above one upper surface side weft so as to form a knuckle and then passing below three upper surface side wefts, which are alternately repeated. Further, although the binding wefts are not included in a weaving pattern in which the upper surface side warp 1U is interwoven with the upper surface side wefts, the upper surface side warp 1U passes above the binding wefts (4'B, 9'B, and 19'B) and passes below the binding weft 14'B.

The upper surface side warp 5U has the same weaving pattern as that of the upper surface side warp 1U and has a weaving pattern where the upper surface side warp 5U goes up and down by alternately passing above one upper surface side weft and below three upper surface side wefts. Although the weaving position is shifted in the warp direction compared to that of the upper surface side warp 1U, the upper surface side warps (2U, 3U, 6U, and 7U) have the same weaving pattern as that of the upper surface side warp 1U and have a weaving pattern where the upper surface side warps go up and down by alternately passing above one upper surface side weft and below three upper surface side wefts.

As described, the upper surface side warps (1U to 3U and 5U to 7U) have the same weaving pattern except for the binding wefts (4'B, 9'B, 14'B, and 19'B), form knuckles at constant intervals with respect to the upper surface side wefts (1'U to 3'U, 5'U to 8'U, 10'U to 13'U, 15'U to 18'U, and 20'U), and are interwoven without destroying the obverse surface texture. Without being interwoven with the lower surface side wefts, the upper surface side warps (1U to 3U and 5U to 7U) are interwoven only with the upper surface side wefts and the binding wefts so as to form a part of the upper surface side fabric. The upper surface side warps (1U to 3U and 5U to 7U) have a common weaving pattern for the wefts except for the binding wefts (4'B, 9'B, 14'B, and 19'B).

The lower surface side warp 1L passes below the lower surface side wefts (6'L and 13'L) so as to form knuckles, respectively, and passes above the two lower surface side wefts (8'L and 11'L) and above the four lower surface side wefts (1'L, 3'L, 16'L, and 18'L) between the knuckles. Further, the lower surface side warp 1L passes below the binding wefts (9'B, 14'B, and 19'B) and passes above the binding weft 4'B. The lower surface side warps (2L, 3L, and 5L to 7L) have the same weaving pattern as that of the lower surface side warp 1 and are woven passing below one lower surface side weft, above two lower surface side wefts, below one lower surface side weft, and above four lower surface side wefts. As described, without being interwoven with the upper surface side wefts, the lower surface side warps (1L to 3L and 5L to 7L) are interwoven only with the lower surface side wefts and the binding wefts so as to form a part of the lower surface side fabric.

Further, the lower surface side warps (1L to 3L and 5L to 7L) also have a common weaving pattern except for the binding wefts (4'B, 9'B, 14'B, and 19'B) and have a weaving pattern in which the lower surface side warps are woven while passing below one lower surface side weft, above two lower surface side wefts, below one lower surface side weft, and above four lower surface side wefts. As described, the binding wefts (4'B, 9'B, 14'B, and 19'B) are not included in a weaving pattern of the upper surface side fabric and the lower surface side fabric.

Figure 5B:
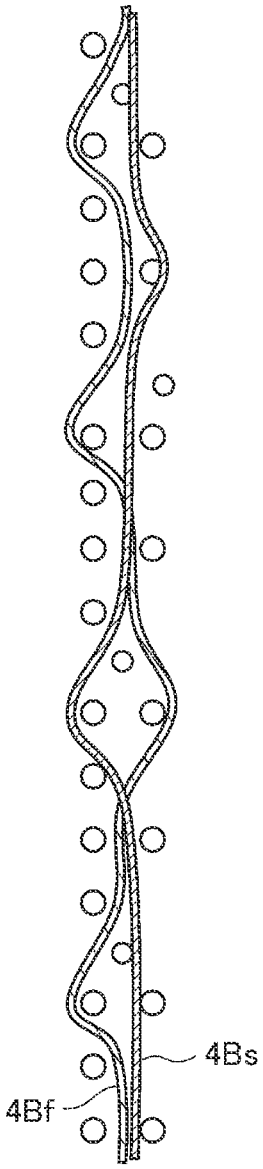

FIG. 5B shows a form in which a pair formed by the first binding warp 4Bf and the second binding warp 4Bs is interwoven with the upper and lower surface side wefts and the binding wefts. The first binding warp 4Bf and the second binding warp 4Bs form a pair facing each other vertically and intersect with each other due to binding. The upper surface side wefts, the lower surface side wefts, and the binding wefts shown in FIG. 5B are arranged in the same manner as the arrangement of the wefts shown in FIG. 5A.

The first binding warp 4Bf passes above the upper surface side wefts (3'U, 13'U, and 18'U) so as to form three knuckles and passes below the upper surface side wefts (1'U, 2'U, 5'U to 8'U, 10'U to 12'U, 15'U to 17'U, and 20'U). Further, the first binding warp 4Bf passes above the binding wefts (4'B, 14'B, and 19'B) and passes below the binding weft 9'B. The first binding warp 4Bf passes below the lower surface side weft 8'L so as to form one knuckle and passes above the lower surface side wefts other than the lower surface side weft 8'L.

The second binding warp 4Bs passes above the upper surface side weft 8'U so as to form one knuckle and passes below the lower surface side weft 16'L so as to form one knuckle. The second binding warp 4Bs passes below the upper surface side wefts other than the upper surface side weft 8'U and passes above the lower surface side wefts other than the lower surface side weft 16'L. The second binding warp 4Bs passes below the binding wefts (4'B, 14'B, and 19'B) and passes above the binding weft 9'B.

The pair formed by the first binding warp 4Bf and the second binding warp 4Bs has a weaving pattern of being interwoven with the upper surface side wefts (1'U to 3'U, 5'U to 8'U, 10'U to 13'U, 15'U to 18'U, and 20'U) in which the pair is woven passing alternately above one upper surface side weft and below three lower surface side wefts, except for the binding wefts (4'B, 9'B, 14'B, and 19'B). The pair formed by the first binding warp 4Bf and the second binding warp 4Bs has a weaving pattern of being interwoven with the lower surface side wefts (1'L, 3'L, 6'L, 8'L, 11'L, 13'L, 16'L, and 18'L) in which the pair is woven passing above one lower surface side weft, above two lower surface side wefts, below one lower surface side weft, and above four lower surface side wefts, except for the binding wefts (4'B, 9'B, 14'B, and 19'B).

As described, the pair formed by the first binding warp 4Bf and the second binding warp 4Bs has a common weaving pattern with the upper surface side warps (1U to 3U and 5U to 7U) and the lower surface side warps (1L to 3L and 5L to 7L) except for the binding wefts (4'B, 9'B, 14'B, and 19'B). This allows the surface properties of the upper surface side fabric and the lower surface side fabric to be improved. Although the weaving position is shifted in the warp direction, the pair formed by the first binding warp 8Bf and the second binding warp 8Bs has the same weaving pattern as that of the pair formed by the first binding warp 4Bf and the second binding warp 4Bs and exhibits the same function.

The first binding warps (4Bf and 8Bf) and the second binding warps (4Bs and 8Bs) are interwoven with the upper surface side wefts so as to form an upper surface side fabric formed in a predetermined weaving pattern for each warp row. In other words, the upper surface side warps and the first and second binding warps form knuckles that are separated at constant intervals on the upper surface side fabric. This allows for suppression of a decrease in the surface properties of the upper surface side fabric.

The pair formed by the first binding warps (4Bf and 8Bf) and the second binding warps (4Bs and 8Bs) is interwoven with the lower surface side wefts so as to form a lower surface side fabric formed in a predetermined weaving pattern for each warp row. In other words, the lower surface side warps and the first and second binding warps form knuckles that are separated at constant intervals on the lower surface side fabric. This allows for suppression of a decrease in the surface properties of the lower surface side fabric.

The upper surface side warps (1U to 3U and 5U to 7U), the first binding warps (4Bf and 8Bf), and the second binding warps (4Bs and 8Bs) are formed with the same diameter but may be formed with different diameters in another embodiment. Since the first binding warps (4Bf and 8Bf) and the second binding warps (4Bs and 8Bs) also appear on the obverse surface on the upper surface side, a decrease in the surface properties can be suppressed by making the diameters the same as that of the upper surface side warps (1U to 3U and 5U to 7U). The diameter of the lower surface side warps may be larger than the diameter of the upper surface side warps. By setting the diameter of the lower surface side warps to be larger than the diameter of the upper surface side warps, the rigidity and warp-direction elongation characteristics of the industrial fabric 10 can be improved.

In the industrial fabric 10 shown in FIG. 1, the binding is achieved by the pair formed by a binding warp and an upper surface side warp. In the industrial fabric 20 shown in FIG. 4, the binding is achieved by the pair formed by the first and second binding warps. Vertical binding achieved by the pair formed by the first and second binding warps can increase the binding force. In any embodiment, binding warps constitute at least one of two warps vertically arranged.

Figure 6A:
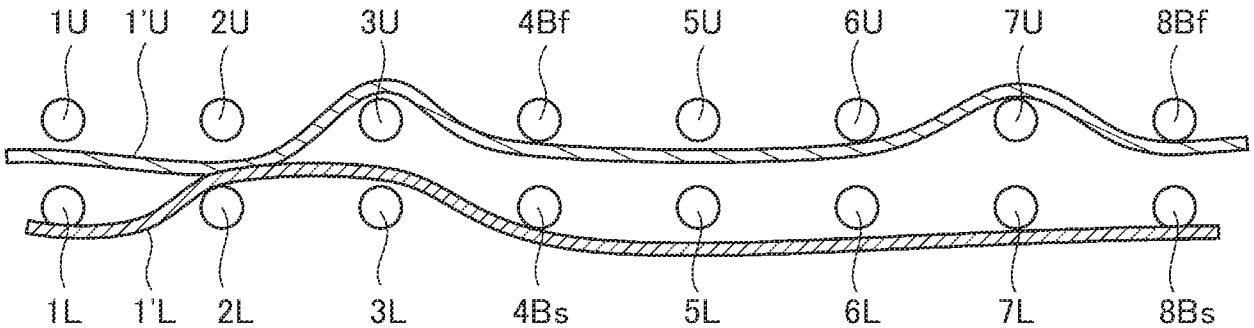
FIG. 6 is a cross-sectional view in the weft direction along wefts in the design diagram shown in FIG. 4.

FIG. 6A shows a form in which a pair formed by the upper surface side weft 1'U and the lower surface side weft 1'L is interwoven with the upper and lower surface side warps. As shown in FIG. 6A, the upper surface side weft 1'U is interwoven with the warps (1U to 3U, 4Bf, 5U to 7U, and 8Bf) located on the upper surface side while passing above one warp and below three warps alternately, passes above the upper surface side warps (3U and 7U) so as to form two knuckles, respectively, and passes below the upper surface side warps (1U, 2U, 5U, and 6U) and the first binding warps (4Bf and 8Bf). The other upper surface side wefts (2'U, 3'U, 5'U to 8'U, 10'U to 13'U, 15'U to 18'U, and 20'U) has the same weaving pattern as that of the upper surface side weft 1'U, are interwoven with the warps (1U to 3U, 4Bf, 5U to 7U, and 8Bf) located on the upper surface side with respect to the upper surface side warps and the first binding warps while passing above one warp and below three warps alternately, and each passes above the upper surface side warps so as to form two knuckles.

The lower surface side weft 1'L passes below six consecutive warps (1L, 4Bs, 5L to 7L, and 8Bs) located on the lower surface side so as to form a long knuckle and passes above two consecutive lower surface side warps (2L and 3L). Although some of the lower surface side wefts (3'L, 6'L, 8'L, 11'L, 13'L, 16'L, and 18'L) have a weaving position that is shifted in the weft direction from that of the lower surface side weft 1'L, the lower surface side wefts have the same weaving pattern as that of the lower surface side weft 1'L, pass below six warps located on the lower surface side so as to form a long knuckle, and pass above two warps located on the lower surface side.

Figure 6B:
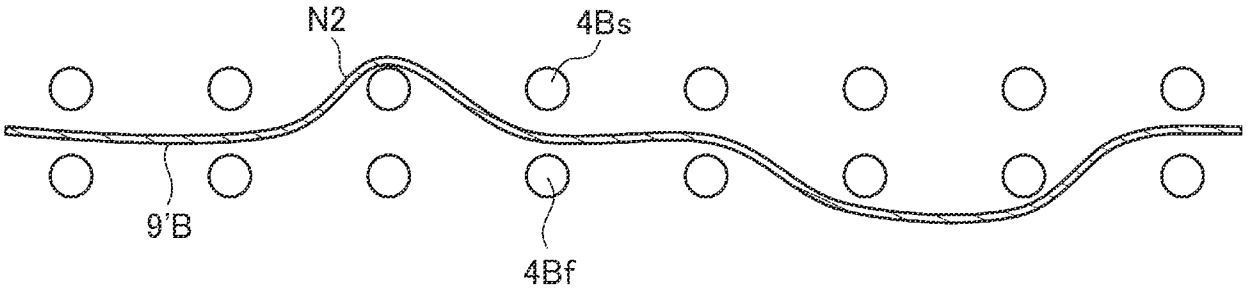

FIG. 6B shows a form in which the binding weft 9'B is interwoven with upper surface side warps, lower surface side warps, and binding warps. The arrangement of the upper surface side warps, the lower surface side warps, and the first and second binding warps shown in FIG. 6B is the same except that the first binding warp 4Bf and the second binding warp 4Bs are upside down.

The binding weft 9'B passes above six warps (1L to 3L, 4Bf, 5L, and 8Bs) located on the lower surface side and passes below two warps (6L and 7L) located on the lower surface side so as to form knuckles. The binding weft 9'B passes above the upper surface side warp 3U so as to form knuckles and passes below the other upper surface side warps (1U, 2U, 4Bs, 5U to 7U, and 8Bf). That is, the binding weft 9'B forms one knuckle on the upper surface side obverse surface texture and one knuckle on the lower surface side obverse surface texture.

The binding weft 9'B forms a knuckle N2 that passes above two or less upper surface side warps 3U out of the warps (1U to 3U, 4Bs, 5U to 7U, and 8Bf) located on the upper surface side. In other words, the binding weft 9'B does not form a knuckle that consecutively passes above three or more warps out of the warps (1U to 3U, 4Bs, 5U to 7U, and 8Bf) located on the upper surface side. The knuckle N2 formed on the upper surface side by the binding weft 9'B passes above one upper surface side warp 3U. Thereby, the part of the binding weft 9'B that is exposed on the obverse surface on the upper surface side can be reduced such that the durability of the binding weft 9'B can be improved. Although the weaving position is shifted in the weft direction compared to that of the binding weft 9'B, the binding wefts (4'B,14'B, and 19'B) have the same weaving pattern and exhibit the same function.

The industrial fabric 20 is bound by the binding wefts (4'B, 9'B, 14'B, and 19'B) arranged apart in the warp direction and a pair formed by the first binding warps (4Bf and 8Bf) and the second binding warps (4Bs and 8Bs). Thus, the industrial fabric 20 can be bound with an appropriate binding force that can suppress internal wear of the upper surface side fabric and the lower surface side fabric. In addition to binding with the binding warps, binding with binding wefts that are not incorporated into the weaving pattern allows for the setting of an appropriate binding force compared to simply increasing the number of binding warps.

The binding wefts (4'B, 9'B, 14'B, and 19'B) are arranged such that the binding wefts are not adjacent in the warp direction. This allows the binding positions to be dispersed, dehydration inhibition due to binding to be suppressed, and air permeability to be improved.

The diameter of the binding wefts (4'B, 9'B, 14'B, and 19'B) is smaller than the diameter of the lower surface side wefts (1'L, 3'L, 6'L, 8'L, 11'L, 13'L, 16'L, and 18'L) and is set to half the size or less, for example. Thereby, even if the binding wefts (4'B, 9'B, 14'B, and 19'B) are not included in a predetermined weaving pattern of each warp, deviations in the predetermined weaving pattern can be suppressed.

The binding wefts (4'B, 9'B, 14'B, and 19'B) are formed in such a manner that the binding wefts are less exposed to the surface than the lower surface side wefts (1'L, 3'L, 6'L, 8'L, 11'L, 13'L, 16'L, and 18'L). Thereby, the wear of the binding wefts (4'B, 9'B, 14'B, and 19'B) having a small diameter can be suppressed.

Third Embodiment

Figure 7:
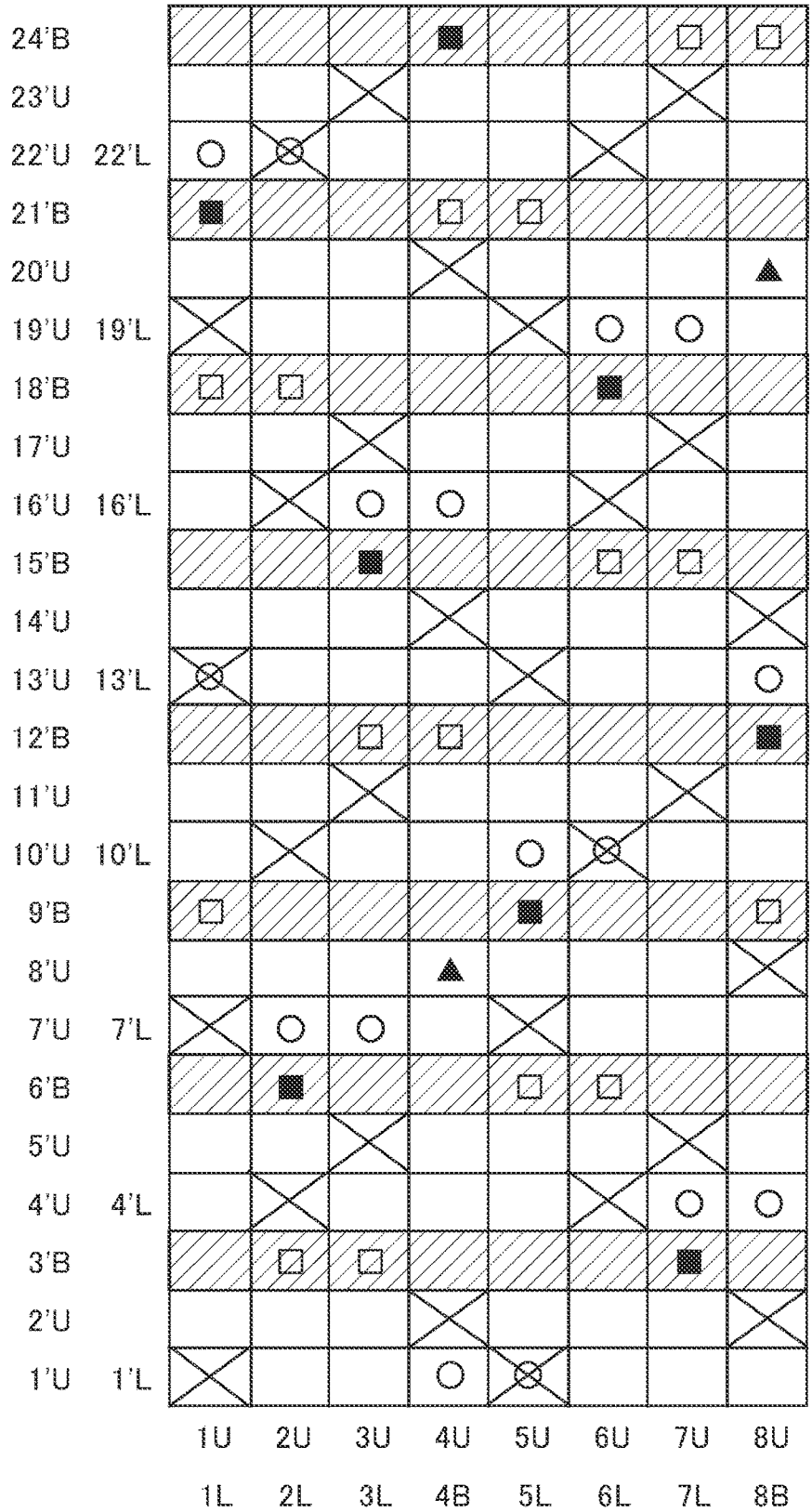
FIG. 7 is a design diagram showing a weave repeat of an industrial fabric according to the third embodiment.

FIG. 7 is a design diagram showing a weave repeat of an industrial fabric 30 according to the third embodiment. Compared to the industrial fabric 10 shown in FIG. 1, the industrial fabric 30 according to the third embodiment is different in that the industrial fabric 30 has a larger number of wefts and has 24 weft rows. Further, there is a difference that the binding wefts of the industrial fabric 10 shown in FIG. 1 are arranged with four consecutive upper surface side wefts interposed therebetween while the binding wefts of the industrial fabric 30 are arranged with two consecutive upper surface side wefts interposed therebetween. The increase in the number of binding wefts can improve the binding force.

Meanwhile, points at which the upper surface side fabric and the lower surface fabric are bound by a pair formed by an upper surface side collapsing yarn and a binding warp and a binding weft in the industrial fabric 30 are the same as those in the industrial fabric 10 shown in FIG. 1.

Fourth Embodiment

Figure 8:
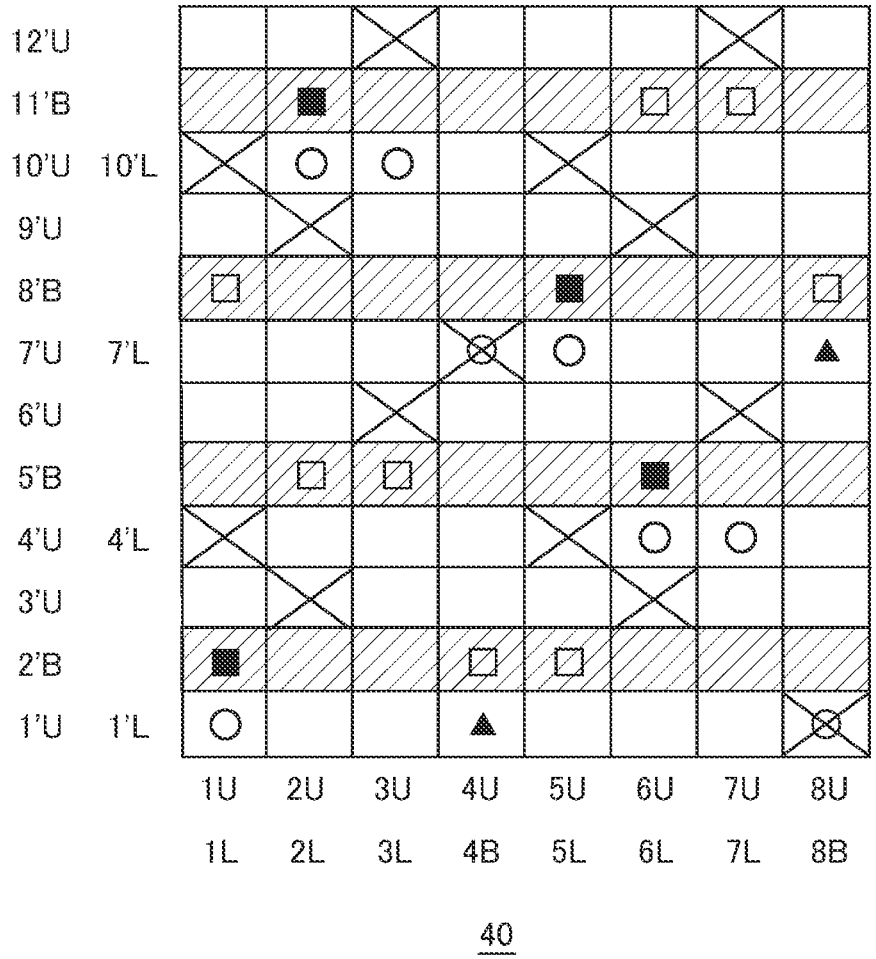
FIG. 8 is a design diagram showing a weave repeat of an industrial fabric according to the fourth embodiment.

FIG. 8 is a design diagram showing a weave repeat of an industrial fabric 40 according to the fourth embodiment. Compared to the industrial fabric 10 shown in FIG. 1, the industrial fabric 40 according to the fourth embodiment is different in that the industrial fabric 40 has a larger number of wefts and has 12 weft rows. Further, there is a difference that the binding wefts of the industrial fabric 10 shown in FIG. 1 are arranged with four consecutive upper surface side wefts interposed therebetween while the binding wefts of the industrial fabric 40 are arranged with two consecutive upper surface side wefts interposed therebetween.

Meanwhile, points at which the upper surface side fabric and the lower surface fabric are bound by a pair formed by an upper surface side collapsing yarn and a binding warp and a binding weft in the industrial fabric 40 are the same as those in the industrial fabric 10 shown in FIG. 1.

Fifth Embodiment

Figure 9:
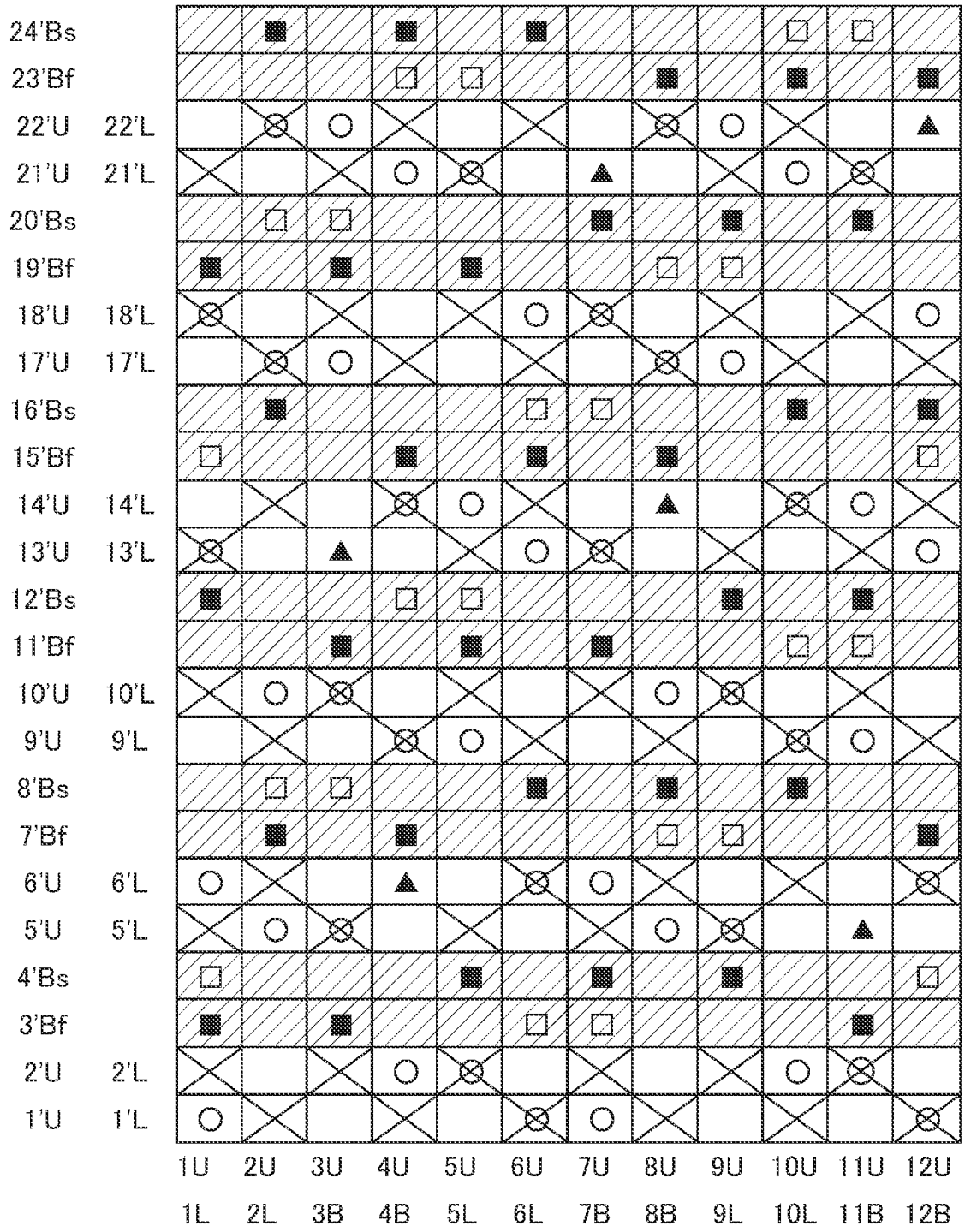
FIG. 9 is a design diagram showing a weave repeat of an industrial fabric according to the fifth embodiment.

FIG. 9 is a design diagram showing a weave repeat of an industrial fabric 50 according to the fifth embodiment. FIG. 10 is a cross-sectional view in the warp direction along warps in the design diagram shown in FIG. 9. FIG. 11 is a cross-sectional view in the weft direction along wefts in the design diagram shown in FIG. 9.

In an industrial fabric 50 according to the fifth embodiment shown in FIG. 9, an upper surface side fabric formed including upper surface side warps (1U to 12U) and upper surface side wefts (1'U, 2'U, 5'U, 6'U, 9'U, 10'U, 13'U, 14'U, 17'U, 18'U, 21'U, and 22'U) and a lower surface side fabric formed including lower surface side warps (1L, 2L, 5L, 6L, 9L, and 10L) and lower surface side wefts (1'L, 2'L, 5'L, 6'L, 9'L, 10'L, 13'L, 14'L, 17'L, 18'L, 21'L, and 22'L) are bound to each other by the binding warps (3B, 4B, 7B, 8B, 11B, and 12B), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs). The first binding wefts and the second binding wefts are simply referred to as binding wefts when the binding wefts are not to be distinguished.

The upper surface side wefts (1'U, 2'U, 5'U, 6'U, 9'U, 10'U, 13'U, 14'U, 17'U, 18'U, 21'U, and 22'U) form a part of the upper surface side fabric. The lower surface side wefts (1'L, 2'L, 5'L, 6'L, 9'L, 10'L, 13'L, 14'L, 17'L, 18'L, 21'L, and 22'L) form a part of the lower surface side fabric. The binding warps (3B, 4B, 7B, 8B, 11B, and 12B) bind the upper surface side fabric and the lower surface side fabric and each form a part of the upper surface side fabric and a part of the lower surface side fabric. The first binding wefts (3'Bf, 7'Bf, 11'Bf, 15'Bf, 19'Bf, and 23'Bf) and the second binding wefts (4'Bs, 8'Bs, 12'Bs, 16'Bs, 20'Bs, and 24'Bs) bind the upper surface side fabric and the lower surface side fabric so as to form a weaving pattern for one upper surface side weft and are thus included in a weaving pattern of the upper surface side warps and the binding warps unlike the industrial fabrics according to the first exemplary embodiment to the fourth exemplary embodiment.

Figure 10A:
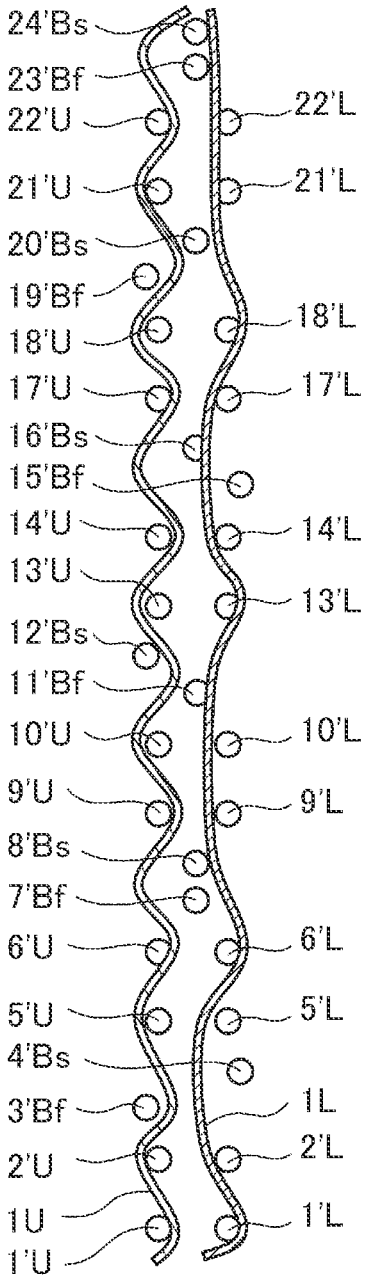
FIG. 10 is a cross-sectional view in the warp direction along warps in the design diagram shown in FIG. 9.
Figure 10B:
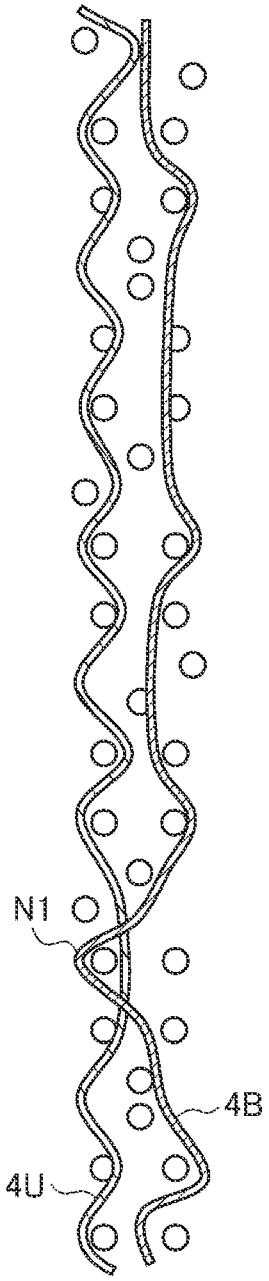

FIG. 10A shows a form in which a pair formed by the upper surface side warp 1U and the lower surface side warp 1L is interwoven with the upper and lower surface side wefts and the binding wefts. The upper surface side wefts, the lower surface side wefts, and the binding wefts shown in FIGS. 10A and 10B are arranged in the same manner. The upper surface side warp 1U and the lower surface side warp 1L are arranged facing each other vertically.

As shown in FIG. 10A, the upper surface side warp 1U is woven above and below wefts alternately one by one that are located on the upper surface side including the upper surface side wefts (1'U, 2'U, 5'U, 6'U, 9'U, 10'U, 13'U, 14'U, 17'U, 18'U, 21'U, and 22'U), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs), passes above the upper surface side wefts (2'U, 5'U, 10'U, 13'U, 18'U, and 21'U) and the binding wefts (4'Bs, 7'Bf, 8'Bs, 11'Bf, 15'Bf, 16'Bs, 20'Bs, 23'Bf, and 24'Bs), and passes below the upper surface side wefts (1'U, 6'U, 9'U, 14'U, 17'U, and 22'U) and the binding wefts (3'Bf, 12'Bs, and 19'Bf). The upper surface side warp 1U passes above the upper surface side wefts (2'U, 5'U, 10'U, 13'U, 18'U, and 21'U) and the binding wefts (7'Bf, 16'Bs, and 23'Bf) so as to form knuckles.

Although the upper surface side warps (2U, 5U, 6U, 9U, and 10U) include those whose weaving position is shifted in the warp direction from that of the upper surface side warp 1U, the upper surface side warps have the same weaving pattern as that of the upper surface side warp 1U and are woven above and below wefts alternately one by one that are located on the upper surface side including the upper surface side wefts (1'U, 2'U, 5'U, 6'U, 9'U, 10'U, 13'U, 14'U, 17'U, 18'U, 21'U, and 22'U), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs). As described, the upper surface side warps (1U, 2U, 5U, 6U, 9U, and 10U) have the same weaving pattern, form knuckles at constant intervals with respect to the upper surface side wefts (1'U, 2'U, 5'U, 6'U, 9'U, 10'U, 13'U, 14'U, 17'U, 18'U, 21'U, and 22'U), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs), and are woven alternately without destroying the obverse surface texture. Without being interwoven with the lower surface side wefts, the upper surface side warps are interwoven only with the upper surface side wefts and the binding wefts so as to form a part of the upper surface side fabric.

The lower surface side warp 1L passes below the lower surface side wefts (1'L, 6'L, 13'L, and 18'L) and the binding wefts (3'Bf, 7'Bf, 8'Bs, 11'Bf, 12'Bs, 16'Bs, 19'Bf, 20'Bs, 23'Bf, and 24'Bs) and passes above the lower surface side wefts (2'L, 5'L, 9'L, 10'L, 14'L, 17'L, 21'L, and 22'L) and the binding wefts (4'Bs and 15'Bf). The lower surface side warp1L is woven passing alternately below one lower surface side weft and above two lower surface side wefts.

Although the lower surface side warps (2L, 5L, 6L, 9L, and 10L) include those whose weaving position is shifted in the warp direction from that of the lower surface side warp 1L, the lower surface side warps have the same weaving pattern as that of the lower surface side warp 1L and are woven passing alternately below one lower surface side weft and above two lower surface side wefts. As described, without being interwoven with all the upper surface side wefts, the lower surface side warps (1L, 2L, 5L, 6L, 9L, and 10L) are interwoven only with the lower surface side wefts and the binding wefts so as to form a part of the lower surface side fabric.

The upper surface side warps (1U, 2U, 5U, 6U, 9U, and 10U) have a common weaving pattern of being woven above and below not only the upper surface side wefts (1'U, 2'U, 5'U, 6'U, 9'U, 10'U, 13'U, 14'U, 17'U, 18'U, 21'U, and 22'U) alternately one by one but also the wefts located on the upper surface side including the first binding wefts (3'Bf, 7'Bf, 11'Bf, 15'Bf, 19'Bf, and 23'Bf) and the second binding wefts (4'Bs, 8'Bs, 12'Bs, 16'Bs, 20'Bs, and 24'Bs) alternately one by one.

Further, the lower surface side warps (1L, 2L, 5L, 6L, 9L, and 10L) have a common weaving pattern in which the lower surface side warps are interwoven with wefts located on the lower surface side while passing alternately below one weft located on the lower surface side and above two wefts located on the lower surface side.

FIG. 10B shows a form in which a pair formed by the upper surface side warp 4U and the binding warp 4B is interwoven with the upper and lower surface side wefts and the binding wefts. The upper surface side warp 4U and the binding warp 4B form a pair facing each other vertically and intersect with each other due to the binding by the binding warp 4B.

The upper surface side warp 4U passes above the upper surface side wefts (1'U, 9'U, 14'U, 17'U, and 22'U) and the binding wefts (3'Bf, 4'Bf, 8'Bs, 11'Bf, 12'Bs, 16'Bs, 19'Bf, 20'Bs, and 23'Bf) and passes below the upper surface side wefts (2'U, 5'U, 6'U, 10'U, 13'U, 18'U, and 21'U) and the binding wefts (7'Bf, 15'Bf, and 24'Bs).

The binding warp 4B passes below the lower surface side wefts (2'L, 9'L, 14'L, and 21'L) and the binding wefts (3'Bf, 4'Bs, 7'Bf, 8'Bs, 11'Bf, 15'Bf, 16'Bs, 19'Bf, 20'Bs, and 24'Bs) so as to form a knuckle N1 passing above the upper surface side weft 6'U. With respect to the lower surface side wefts (1'L, 2'L, 5'L to 6'L, 9'L, 10'L, 13'L, 14'L, 17'L, 18'L, 21'L, and 22'L), the binding warp 4B passes below one lower surface side weft and above two lower surface side wefts alternately so as to form knuckles at constant intervals for the lower surface side wefts and is woven without destroying the reverse surface texture. The binding warp 4B passes above the binding wefts (12'B and 23'Bf).

For the upper surface side fabric, the binding warp 4B passes above the upper surface side weft 6'U for binding so as to form only one knuckle N1 on the obverse surface side and passes below the upper surface side wefts other than the upper surface side weft 6'U.

The pair formed by the upper surface side warp 4U and the binding warp 4B has a common weaving pattern with the upper surface side warps (1U, 2U, 5U, 6U, 9U, and 10U) and the lower surface side warps (1L, 2L, 5L, 6L, 9L, and 10L). In other words, the pair formed by the upper surface side warp 4U and the binding warp 4B has a weaving pattern in which the pair is woven above and below the wefts alternately one by one that include the upper surface side wefts and the first and second binding wefts and that are located on the upper surface side. Although the weaving position is shifted in the warp direction, the pair formed by the upper surface side warps (3U, 7U, 8U, 11U, and 12U) and the binding warps (3B, 7B, 8B, 11B, and 12B) has the same weaving pattern as that of the pair formed by the upper surface side warp 4U and the binding warp 4B and exhibits the same function.

At the position where the binding warp 4B forms a knuckle N1 on the obverse surface side, the upper surface side warp 4U does not form a knuckle on the obverse surface side after passing below the upper surface side weft 6'U and acts as an upper surface side collapsing yarn 4U that collapses a part of the upper surface side obverse surface texture.

The upper surface side warp 4U (upper surface side collapsing yarn) and the binding warp 4B complement each other in the obverse surface texture of the upper surface side fabric, thereby forming the same obverse surface texture as that of the upper surface side warps other than the upper surface side collapsing yarn 4U and forming knuckles for the same number of upper surface side wefts as the number of the upper surface side warps other than the upper surface side collapsing yarn 4U. The pair formed by the upper surface side warp 4U and the binding warp 4B has a common weaving pattern with the upper surface side warps (1U, 2U, 5U, 6U, 9U, and 10U) and the lower surface side warps (1L, 2L, 5L, 6L, 9L, and 10L). This prevents the binding warp 4B from lowering the surface properties of the upper surface side fabric. Further, by using a pair formed by the upper surface side collapsing yarn 4U and the binding warp 4B for the binding, a decrease in the surface properties can be suppressed compared to a case where binding warps are vertically provided.

The upper surface side warps (1U to 12U) and the binding warps (3B, 4B, 7B, 8B, 11B, and 12B) are interwoven with the wefts located on the upper surface side including the upper surface side wefts and the first and second binding wefts so as to form an upper surface side fabric formed in a predetermined weaving pattern for each warp row. In other words, the upper surface side warps (1U to 12U) and the binding warps (3B, 4B, 7B, 8B, 11B, and 12B) form knuckles that are separated at constant intervals on the upper surface side fabric. This allows for suppression of a decrease in the surface properties of the upper surface side fabric.

The lower surface side warps (1L, 2L, 5L, 6L, 9L, and 10L) and the binding warps (3B, 4B, 7B, 8B, 11B, and 12B) are interwoven with the wefts located on the lower surface side including the lower surface side wefts and the first and second binding wefts so as to form a lower surface side fabric formed in a predetermined weaving pattern for each warp row. In other words, the lower surface side warps (1L, 2L, 5L, 6L, 9L, and 10L) and the binding warps (3B, 4B, 7B, 8B, 11B, and 12B) form knuckles that are separated at constant intervals on the lower surface side fabric. This allows for suppression of a decrease in the surface properties of the lower surface side fabric.

The upper surface side warps (1U to 12U) and the binding warps (3B, 4B, 7B, 11B, and 12B) are formed with the same diameter but may be formed with different diameters in another embodiment. Since the binding warps also appear on the obverse surface on the upper surface side, a decrease in the surface properties can be suppressed by making the diameter the same as that of the upper surface side warps. The diameter of the lower surface side warps may be larger than the diameter of the upper surface side warps. By setting the diameter of the lower surface side warps to be larger than the diameter of the upper surface side warps, the rigidity and warp-direction elongation characteristics of the industrial fabric 10 can be improved.

The pair formed by the upper surface side warp 3U and the binding warp 3B is adjacent to the pair formed by the upper surface side warp 4U and the binding warp 4B in the weft direction. This allows the binding force of the upper surface side fabric and the lower surface side fabric to be increased.

Figure 11A:
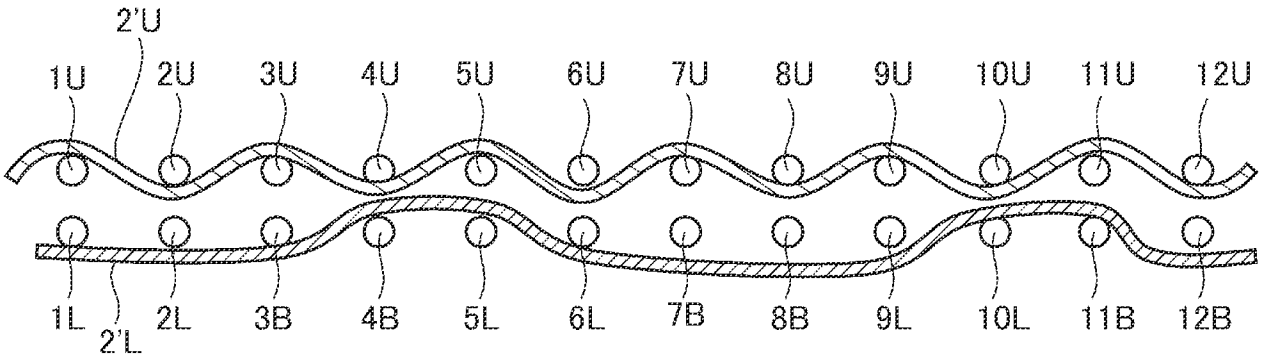
FIG. 11 is a cross-sectional view in the weft direction along wefts in the design diagram shown in FIG. 9.

FIG. 11A shows a form in which a pair formed by the upper surface side weft 2'U and the lower surface side weft 2'L is interwoven with the upper and lower surface side warps and the binding warps. As shown in FIG. 11A, the upper surface side weft 2'U is woven above and below the upper surface side warps (1U to 12U) alternately one by one, passes above the upper surface side warps (1U, 3U, 5U, 7U, 9U, and 11U) so as to form knuckles, respectively, and passes below the upper surface side warps (2U, 4U, 6U, 8U, 10U, and 12U). The other upper surface side wefts (1'U, 5'U, 6'U, 9'U, 10'U, 13'U, 14'U, 17'U, 18'U, 21'U, and 22'U) have the same weaving pattern as that of the upper surface side weft 2'U and are each woven above and below the upper surface side warps (1U to 12U) and the binding warps alternately one by one. Depending on upper surface side wefts, the binding targets of the upper surface side fabric includes not only the upper surface side warps but also the binding warps.

The lower surface side weft 2'L passes below four warps (6L, 7B, 8B, and 9L) located on the lower surface side and warps (1L, 2L, 3B, and 12B) so as to form two knuckles and passes above two warps (4B and 5L) located on the lower surface side and warps (10L and 11B). The warps located on the lower surface side include not only the lower surface side warps but also the binding warps. Although the other lower surface side wefts (1'L, 5'L, 6'L, 9'L, 10'L, 13'L, 14'L, 17'L, 18'L, 21'L, and 22'L) include those whose weaving position is shifted in the weft direction from that of the lower surface side weft 2'L, the lower surface side wefts have the same weaving pattern as that of the lower surface side weft 2'L, and pass alternately below four warps located on the lower surface side and above two warps located on the lower surface side.

Figure 11B:
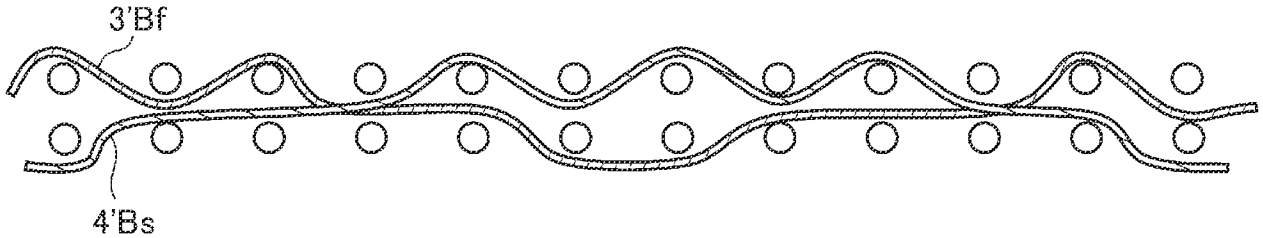

FIG. 11B shows a form in which the first binding weft 3'Bf and the second binding weft 4'Bs are interwoven with the upper and lower surface side warps and the binding warps. The first binding weft 3'Bf passes above the upper surface side warps (1U, 3U, and 11U) so as to form knuckles N2, respectively, and passes below the other upper surface side warps (2U, 4U to 10U, and 12U). The first binding weft 3'Bf passes below two warps (6L and 7B) located on the lower surface side so as to form a knuckle N4 and passes above the other warps (1L, 2L, 3B, 4B, 5L, 8B, 9L, 10L, 11B, and 12B) located on the lower surface side. That is, the first binding weft 3'Bf forms three knuckles on the upper surface side obverse surface texture and one knuckle on the lower surface side obverse surface texture.

The second binding weft 4'Bs passes above the upper surface side warps (5U, 7U, and 9U) so as to form knuckles N3, respectively, and passes below the other upper surface side warps (1U to 4U, 6U, 8U, and 10U to 12U). The second binding weft 4'Bs passes below two warps (1L and 12B) located on the lower surface side so as to form a knuckle N5 and passes above the other warps (2L, 3B, 4B, 5L, 6L, 7B, 8B, 9L, 10L, and 11B) located on the lower surface side. That is, the second binding weft 4'Bs forms three knuckles on the upper surface side obverse surface texture and one knuckle on the lower surface side obverse surface texture, just like the first binding weft 3'Bf.

The first binding weft 3'Bf and the second binding weft 4'Bs form knuckles (N2 and N3) that consecutively pass above two or less upper surface side warps out of the upper surface side warps (1U to 12U). In other words, the first binding weft 3'Bf and the second binding weft 4'Bs do not form knuckles that consecutively pass above three or more upper surface side warps out of the upper surface side warps (1U to 12U). The knuckles (N2 and N3) formed on the upper surface side by the first binding weft 3'Bf and the second binding weft 4'Bs are each formed passing above only one upper surface side warp. Thereby, the formation of a long knuckle on the upper surface side obverse surface by the first binding weft 3'Bf and the second binding weft 4'Bs can be prevented. When used in a paper machine, the obverse surface of an industrial fabric becomes worn by contact with each roll and dehydration equipment. However, by avoiding knuckles of binding yarns from becoming long, the damage to the binding yarns due to wear can be suppressed.

The first binding weft 3'Bf and the second binding weft 4'Bs form knuckles (N4 and N5) that consecutively pass below two or less lower surface side warps out of the lower surface side warps. In other words, the first binding weft 3'Bf and the second binding weft 4'Bs do not form knuckles that consecutively pass below three or more lower surface side warps out of the lower surface side warps. The knuckles (N4 and N5) formed on the lower surface side by the first binding weft 3'Bf and the second binding weft 4'Bs are each formed passing below two consecutive lower surface side warps. Thereby, the part of the first binding weft 3'Bf and the part of the second binding weft 4'Bs that are exposed can be reduced such that the durability of the first binding weft 3'Bf and the second binding weft 4'Bs can be improved. Although the weaving position is shifted in the weft direction compared to that of the first binding weft 3'Bf and the second binding weft 4'Bs, the other first binding wefts (7'B, 11'B, 15'Bf, 19'Bf, and 23'Bf) and second binding wefts (8'Bs, 12'Bs, 16'Bs, 20'Bs, and 24'Bs) have the same weaving pattern and exhibit the same function.

The first binding wefts (3'Bf, 7'B, 11'B, 15'Bf, 19'Bf, and 23'Bf) and the second binding wefts (4'Bs, 8'Bs, 12'Bs, 16'Bs, 20'Bs, and 24'Bs) are arranged being adjacent to each other in the warp direction in pairs. This allows the binding force for binding the upper surface side fabric and the lower surface side fabric to be increased.

A pair formed by a first binding weft and a second binding weft that are adjacent to each other forms knuckles for one upper surface side weft on the obverse surface of the upper surface side fabric. In other words, the number of knuckles formed by the pair formed by the first binding weft and the second binding weft that are adjacent to each other on the obverse surface of the upper surface side fabric is the same as the number of knuckles formed by one upper surface side weft on the obverse surface of the upper surface side weft. This allows for suppression of a decrease in the surface properties of the upper surface side fabric. The pair formed by the first binding weft and the second binding weft that are adjacent to each other forms a weaving pattern for one upper surface side weft on the obverse surface of the upper surface side fabric.

The industrial fabric 50 is bound by the pairs of the first binding wefts and the second binding wefts and the pairs of the binding warps and the upper surface side warps. Thus, the industrial fabric 50 can be bound with an appropriate binding force that can suppress internal wear of the upper surface side fabric and the lower surface side fabric. In addition to binding with the binding warps, binding with binding wefts allows for the setting of an appropriate binding force compared to simply increasing the number of binding warps.

The diameter of the first and second binding wefts is smaller than the diameter of the lower surface side wefts and is set to half the size or less, for example. Thereby, even if the first and second binding wefts are not included in a predetermined weaving pattern of each warp, deviations in the predetermined weaving pattern can be suppressed. Further, the diameter of the first and second binding wefts may be the same as or smaller than the diameter of the upper surface side wefts.

Further, the pairs formed by the first binding wefts and the second binding wefts are formed so as to be less exposed to the lower surface side obverse surface compared to the lower side wefts. While the pairs formed by the first binding wefts and the second binding wefts pass below two consecutive warps out of the warps located on the lower surface side so as to be exposed on the obverse surface on the lower surface side, the lower surface side wefts pass below four consecutive warps out of the warps located on the lower surface side so as to be exposed on the obverse surface on the lower surface side. Thereby, the wear of the first and second binding wefts having a small diameter can be suppressed.

Sixth Embodiment

Figure 12:
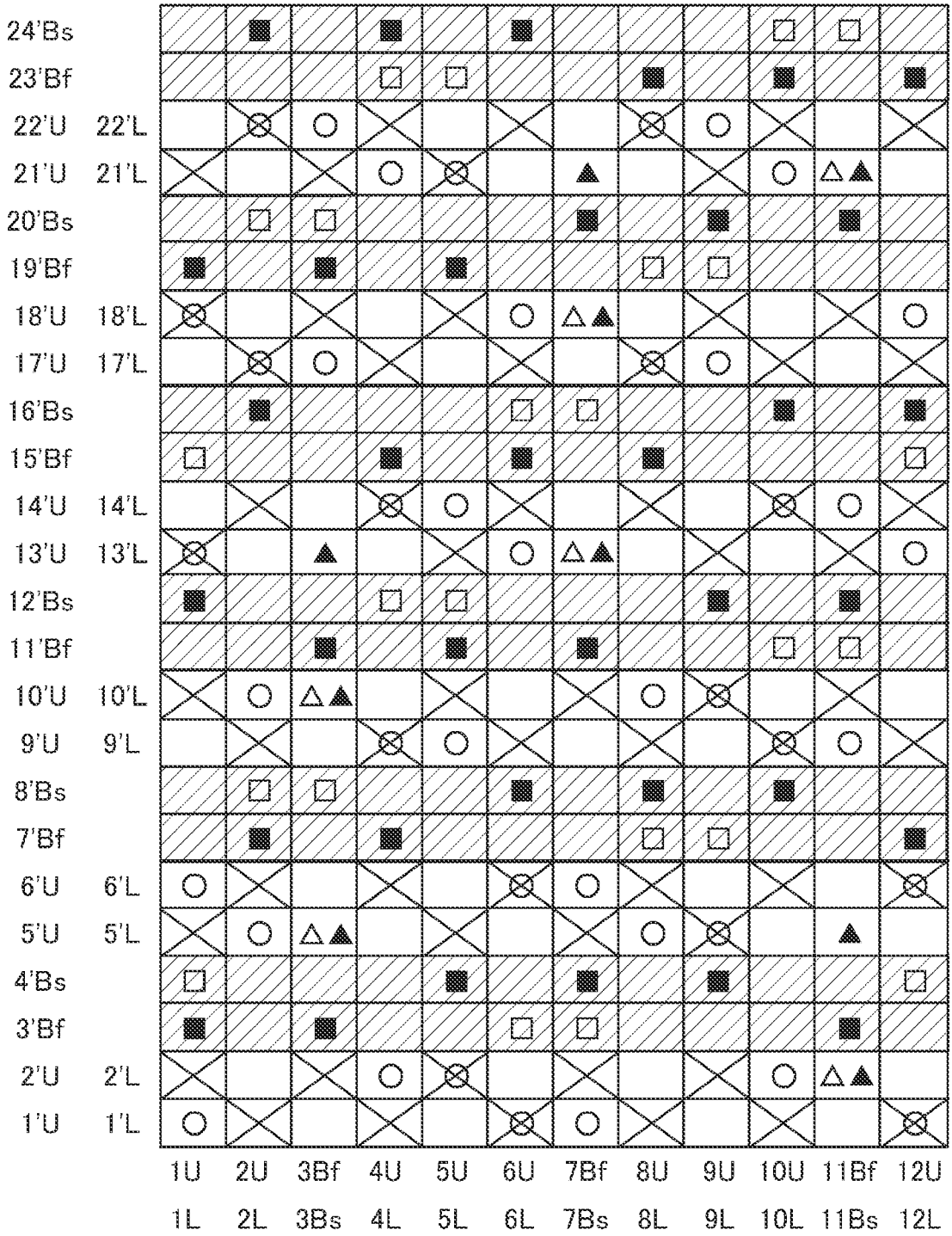
FIG. 12 is a design diagram showing a weave repeat of an industrial fabric according to the sixth embodiment.

FIG. 12 is a design diagram showing a weave repeat of an industrial fabric 60 according to the sixth embodiment. FIG. 13 is a cross-sectional view in the warp direction along warps in the design diagram shown in FIG. 12. FIG. 14 is a cross-sectional view in the weft direction along wefts in the design diagram shown in FIG. 12.

In an industrial fabric 60 according to the sixth embodiment shown in FIG. 12, an upper surface side fabric formed including upper surface side warps (1U, 2U, 4U to 6U, 8U to 10U, and 12U) and upper surface side wefts (1'U, 2'U, 5'U, 6'U, 9'U, 10'U, 13'U, 14'U, 17'U, 18'U, 21'U, and 22'U) and a lower surface side fabric formed including lower surface side warps (1L, 2L, 4L to 6L, 8L to 10L, and 12L) and lower surface side wefts (1'L, 2'L, 5'L, 6'L, 9'L, 10'L, 13'L, 14'L, 17'L, 18'L, 21'L, and 22'L) are bound to each other by the first binding warps (3Bf, 7Bf, and 11Bf), the second binding warps (3Bs, 7Bs, and 11Bs), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs). The first binding warps and the second binding warps are simply referred to as binding warps when the binding warps are not to be distinguished, and the first binding wefts and the second binding wefts are simply referred to as binding wefts when the binding wefts are not to be distinguished.

The first binding wefts (3'Bf, 7'Bf, 11'Bf, 15'Bf, 19'Bf, and 23'Bf) and the second binding wefts (4'Bs, 8'Bs, 12'Bs, 16'Bs, 20'Bs, and 24'Bs) bind the upper surface side fabric and the lower surface side fabric so as to form a weaving pattern for one upper surface side weft and are thus included in a weaving pattern of the upper surface side warps and the binding warps.

Figure 13A:
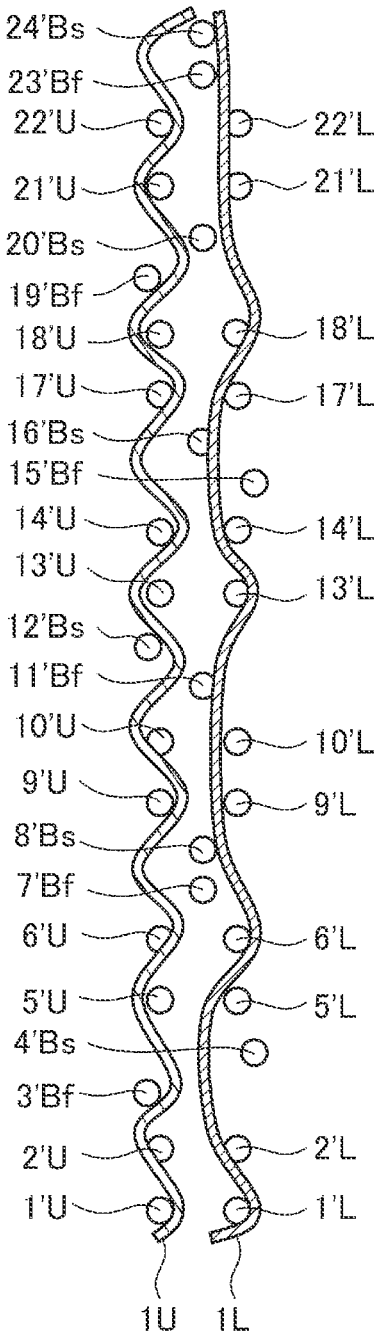
FIG. 13 is a cross-sectional view in the warp direction along warps in the design diagram shown in FIG. 12.
Figure 13B:
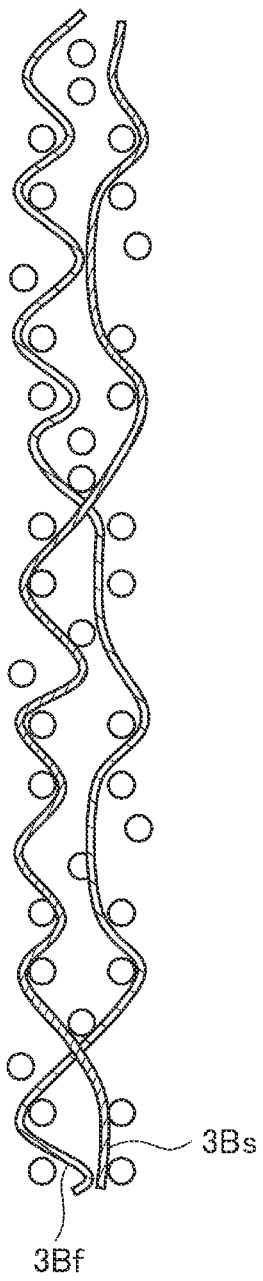

FIG. 13A shows a form in which a pair formed by the upper surface side warp 1U and the lower surface side warp 1L is interwoven with the upper and lower surface side wefts and the binding wefts. The upper surface side wefts, the lower surface side wefts, and the binding wefts shown in FIGS. 13A and 13B are arranged in the same manner. The upper surface side warp 1U and the lower surface side warp 1L are arranged facing each other vertically.

As shown in FIG. 13A, the upper surface side warp 1U is woven above and below the upper surface side wefts (1'U, 2'U, 5'U, 6'U, 9'U, 10'U, 13'U, 14'U, 17'U, 18'U, 21'U, and 22'U), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs) alternately one by one, passes above the upper surface side wefts (2'U, 5'U, 10'U, 13'U, 18'U, and 21'U) and the binding wefts (7'Bf, 16'Bs, and 23'Bf), and passes below the upper surface side wefts (1'U, 6'U, 9'U, 14'U, 17'U, and 22'U) and the binding wefts (3'Bf, 12'Bs, and 19'Bf). Further, the binding wefts are included in a weaving pattern in which the upper surface side warp 1U is woven above and below the upper surface side wefts and the binding wefts alternately one by one. The upper surface side warp 1U passes above the binding wefts (4'Bs, 7'Bf, 8'Bs, 11'Bf, 15'Bf, 16'Bs, 20'Bs, 23'Bf, and 24'Bs) and passes below the binding wefts (3'Bf, 12'Bs, and 19'Bf).

Although the upper surface side warps (2U, 4U to 6U, 8U to 10U, and 12U) include those whose weaving position is shifted in the warp direction from that of the upper surface side warp 1U, the upper surface side warps have the same weaving pattern as that of the upper surface side warp 1U and are woven above and below the upper surface side wefts (1'U, 2'U, 5'U, 6'U, 9'U, 10'U, 13'U, 14'U, 17'U, 18'U, 21'U, and 22'U), the first binding wefts (3'Bf, 7'Bf, 11'Bf, 15'Bf, 19'Bf, and 23'Bf), and the second binding wefts (4'Bs, 8'Bs, 12'Bs, 16'Bs, 20'Bs, and 24'Bs) alternately one by one. As described, the upper surface side warps (1U, 2U, 4U to 6U, 8U to 10U, and 12U) have the same weaving pattern, form knuckles at constant intervals with respect to the upper surface side wefts and the binding wefts, and are woven alternately without destroying the obverse surface texture. Without being interwoven with the lower surface side wefts, the upper surface side warps are interwoven only with the upper surface side wefts and the binding wefts so as to form a part of the upper surface side fabric.

The lower surface side warp 1L passes below the lower surface side wefts (1'L, 6'L, 13'L, and 18'L) so as to form knuckles, respectively, and passes above the lower surface side wefts (2'L, 5'L, 9'L, 10'L, 14'L, 17'L, 21'L, and 22'L). The lower surface side warp1L is woven passing alternately below one lower surface side weft and above two lower surface side wefts. Further, the lower surface side warp 1L passes below the binding wefts (3' Bf, 7' Bf, 8' Bs, 11' Bf, 12' Bs, 16' Bs, 19' Bf, 20' Bs, 23' Bf, and 24'Bs) and passes above the binding wefts (4'Bs and 15'Bf).

Although the lower surface side warps (2L, 4L to 6L, 8L to 10L, and 12L) include those whose weaving position is shifted in the warp direction compared to that of the lower surface side warp 1L, the lower surface side warps have the same weaving pattern as that of the lower surface side warp 1L and are woven passing alternately below one lower surface side weft and above two lower surface side wefts. As described, without being interwoven with all the upper surface side wefts, the lower surface side warps (1L, 2L, 4L to 6L, 8L to 10L, and 12L) are interwoven only with the lower surface side wefts and the binding wefts so as to form a part of the lower surface side fabric.

The upper surface side warps (1U, 2U, 4U to 6U, 8U to 10U, and 12U) have a common weaving pattern with the wefts located on the upper surface side including the upper surface side wefts and the first and second binding wefts. In other words, the upper surface side warps each have a weaving pattern of being woven above and below the wefts located on the upper surface side alternately one by one.

Further, the lower surface side warps (1L, 2L, 5L, 6L, 9L, and 10L) also have a common weaving pattern and have a weaving pattern in which the lower surface side warps are interwoven with the lower surface side wefts (1'L, 2'L, 5'L, 6'L, 9'L, 10'L, 13'L, 14'L, 17'L, 18'L, 21'L, and 22'L) while passing alternately below one of the lower surface side wefts and above two of the lower surface side wefts.

FIG. 13B shows a form in which a pair formed by the first binding warp 3Bf and the second binding warp 3Bs is interwoven with the upper and lower surface side wefts and the binding wefts. The first binding warp 3Bf and the second binding warp 3Bs form a pair facing each other vertically and intersect with each other due to binding.

The first binding warp 3Bf passes above the upper surface side wefts (2'U, 18'U, and 21'U) and the binding wefts (15'Bf and 23'Bf) so as to form knuckles, respectively, and passes below the upper surface side wefts (1'U, 5'U, 6'U, 9'U, 10'U, 13'U, 14'U, 17'U, and 22'U) and the binding wefts (3'Bf, 4'Bs, 7'Bf, 11'Bf, 12'Bs, 16'Bs, and 19'Bf). The first binding warp 3Bf passes below the lower surface side wefts (17'L and 22'L) so as to form knuckles, respectively, and passes above the lower surface side wefts (1'L, 2'L, 5'L, 6'L, 9'L, 10'L, 13'L, 14'L, 18'L, and 21'L) and the binding wefts (8'Bs, 20'Bs, 23'Bf, and 24'Bs). The first binding warp 3Bf passes below the lower surface side wefts (17'L and 22'L) so as to form two knuckles and passes above the wefts (2'U, 15'Bf, 18'U, 21'U, and 23'Bf) located on the upper surface side so as to form five knuckles.

The second binding warp 3Bs passes above the upper surface side wefts (5'U, 10'U, and 13'U) and the binding weft (7'Bf) so as to form knuckles, respectively, and passes below the upper surface side wefts (1'U, 2'U, 6'U, 9'U, 14'U, 17'U, 18'U, 21'U, and 22'U) and the binding wefts (3'Bf, 11'Bs, 15'Bf, 16'Bs, 19'Bf, 23'Bf, and 24'Bs). The second binding warp 3Bs passes below the lower surface side wefts (5'L and 10'L) so as to form knuckles, respectively, and passes above the lower surface side wefts (1'L, 2'L, 6'L, 9'L, 13'L, 14'L, 17'L, 18'L, 21'L, and 22'L) and the binding wefts (4'Bs, 7'Bf, 8'Bs, 12'Bs, and 20'Bs). The second binding warp 3Bs passes below the lower surface side wefts (17'L and 22'L) so as to form two knuckles and passes above the wefts (5'U, 7'Bf, 10'U, and 13'U) located on the upper surface side so as to form four knuckles.

The pair formed by the first binding warp 3Bf and the second binding warp 3Bs has a weaving pattern in which the pair is woven passing above and below the wefts alternately one by one that include the first binding wefts and the second binding wefts and that are located on the upper surface side. The pair formed by the first binding warp 3Bf and the second binding warp 3Bs has a weaving pattern in which the pair is interwoven with the lower surface side wefts while passing below one lower surface side weft and above two lower surface side wefts alternately, except for the first binding wefts and the second binding wefts.

As described, the pair formed by the first binding warp 3Bf and the second binding warp 3Bs has a common weaving pattern as that of the upper surface side warps and the lower surface side warps. This allows the surface properties of the upper surface side fabric and the lower surface side fabric to be improved. Although the weaving position is shifted in the warp direction, the pair formed by the first binding warps (7Bf and 11Bf) and the second binding warps (7Bs and 11Bs) has the same weaving pattern as that of the pair formed by the first binding warp 3Bf and the second binding warp 3Bs and exhibits the same function.

The first binding warps (3Bf, 7Bf, and 11Bf) and the second binding warps (3Bs, 7Bs, and 11Bs) are interwoven with the wefts located on the upper surface side so as to form an upper surface side fabric formed in a predetermined weaving pattern for each warp row. In other words, the upper surface side warps and the first and second binding warps form knuckles that are separated at constant intervals on the upper surface side fabric. This allows for suppression of a decrease in the surface properties of the upper surface side fabric.

The pair formed by the first binding warps (3Bf, 7Bf, and 11Bf) and the second binding warps (3Bs, 7Bs, and 11Bs) is interwoven with the lower surface side wefts so as to form a lower surface side fabric formed in a predetermined weaving pattern for each warp row. In other words, the lower surface side warps and the first and second binding warps form knuckles that are separated at constant intervals on the lower surface side fabric. This allows for suppression of a decrease in the surface properties of the lower surface side fabric.

The upper surface side warps and the first and second binding warps are formed with the same diameter but may be formed with different diameters in another embodiment. Since the first and second binding warps also appear on the obverse surface on the upper surface side, a decrease in the surface properties can be suppressed by making the diameter the same as that of the upper surface side warps. The diameter of the lower surface side warps may be larger than the diameter of the upper surface side warps. By setting the diameter of the lower surface side warps to be larger than the diameter of the upper surface side warps, the rigidity and warp-direction elongation characteristics of the industrial fabric 10 can be improved.

In the industrial fabric 50 shown in FIG. 9, the binding is achieved by the pair formed by a binding warp and an upper surface side warp. In the industrial fabric 60 shown in FIG. 12, the binding is achieved by the pair formed by the first and second binding warps. Vertical binding achieved by the pair formed by the first and second binding warps can increase the binding force. In any embodiment, binding warps constitute at least one of two warps vertically arranged.

Figure 14A:
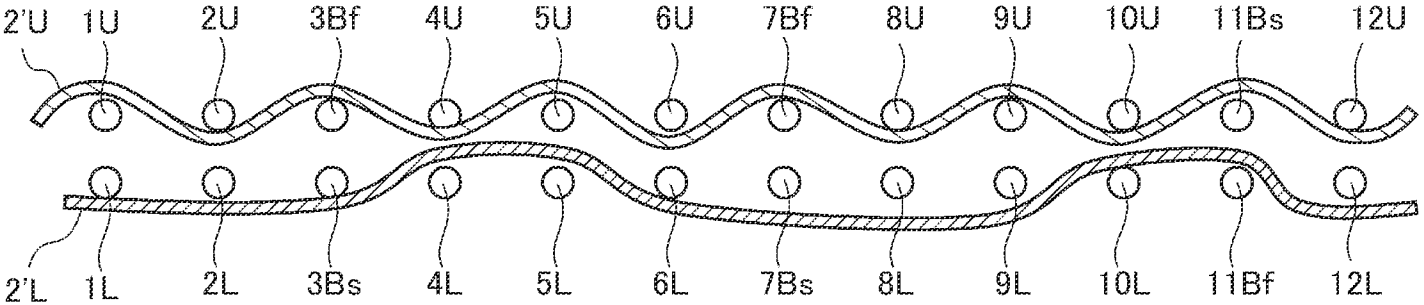
FIG. 14 is a cross-sectional view in the weft direction along wefts in the design diagram shown in FIG. 12.

FIG. 14A shows a form in which a pair formed by the upper surface side weft 2'U and the lower surface side weft 2'L is interwoven with the upper and lower surface side warps and the binding warps. As shown in FIG. 14A, the upper surface side weft 2'U is woven above and below the upper surface side warps (1U, 2U, 4U to 6U, 8U to 10U, and 12U) and the binding warps (3Bf, 7Bf, and 11Bs) alternately one by one, passes above the upper surface side warps (1U, 3Bf, 5U, 7Bf, 9U, and 11Bs) so as to form knuckles, respectively, and passes below the upper surface side warps (2U, 4U, 6U, 8U, 10U, and 12U). The other upper surface side wefts (1'U, 5'U, 6'U, 9'U, 10'U, 13'U, 14'U, 17'U, 18'U, 21'U, and 22'U) have the same weaving pattern as that of the upper surface side weft 2'U and are each woven above and below the upper surface side warps and the binding warps alternately one by one in warp rows of the upper surface side warps and the binding warps.

The lower surface side weft 2'L passes below four warps (6L, 7Bs, 8L, and 9L) located on the lower surface side and four warps (1L, 2L, 3Bs, and 12L) located on the lower surface side so as to form two knuckles and passes above two warps (4L and 5L) located on the lower surface side and two warps (10L and 11Bf) located on the lower surface side. The warps located on the lower surface side include not only the lower surface side warps but also the first and second binding warps. Although the other lower surface side wefts (1'L, 5'L, 6'L, 9'L, 10'L, 13'L, 14'L, 17'L, 18'L, 21'L, and 22'L) include those whose weaving position is shifted in the weft direction from that of the lower surface side weft 2'L, the lower surface side wefts have the same weaving pattern as that of the lower surface side weft 2'L, and pass alternately below four warps located on the lower surface side and above two warps located on the lower surface side.

Figure 14B:
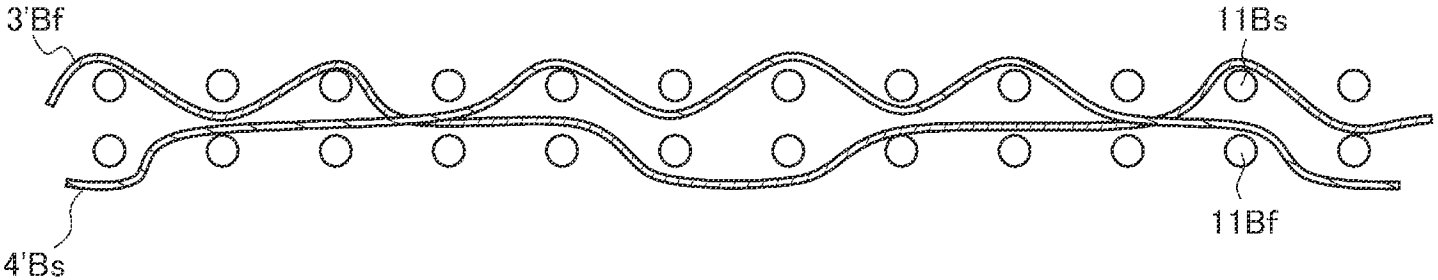

FIG. 14B shows a form in which the first binding weft 3'Bf and the second binding weft 4'Bs are interwoven with the upper and lower surface side warps and the binding warps. In comparison with the warps shown in FIG. 14A, although the first binding warp 11Bf and the second binding warp 11Bs are upside down in FIG. 14B, the arrangement of the other warps is the same.

The first binding weft 3'Bf passes above the warps (1U, 3Bf, and 11Bs) located on the upper surface side so as to form knuckles N2, respectively, and passes below the other warps (2U, 4U to 6U, 7Bs, 8U to 10U, and 12U) located on the upper surface side. The first binding weft 3'Bf passes below two warps (6L and 7Bs) located on the lower surface side so as to form a knuckle and passes above the other warps (1L, 2L, 3Bs, 4L, 5L, 8L to 10L, 11Bf, and 12L) located on the lower surface side. That is, the first binding weft 3'Bf forms three knuckles on the upper surface side obverse surface texture and one knuckle on the lower surface side obverse surface texture.

The second binding weft 4'Bs passes above the warps (5U, 7Bf, and 9U) located on the upper surface side so as to form knuckles N3, respectively, and passes below the other warps (1U, 2U, 3Bf, 4U, 6U, 8U, 10U, 11Bs, and 12U) located on the upper surface side. The second binding weft 4'Bs passes below two warps (1L and 12L) located on the lower surface side so as to form a knuckle and passes above the other warps (2L, 3Bs, 4L to 6L, 7Bs, 8L to 10L, and 11Bf) located on the lower surface side. That is, the second binding weft 4'Bs forms three knuckles on the upper surface side obverse surface texture and one knuckle on the lower surface side obverse surface texture, just like the first binding weft 3'Bf.

The first binding weft 3'Bf and the second binding weft 4'Bs form knuckles that consecutively pass above two or less upper surface side warps out of the warps located on the upper surface side. In other words, the first binding weft 3'Bf and the second binding weft 4'Bs do not form knuckles that consecutively pass above three or more upper surface side warps out of the upper surface side warps. The knuckles formed on the upper surface side by the first binding weft 3'Bf and the second binding weft 4'Bs are each formed passing above only one upper surface side warp.

The first binding weft 3'Bf and the second binding weft 4'Bs form knuckles that consecutively pass below two or less warps located on the lower surface side out of the warps located on the lower surface side that include the lower surface side warps and the binding warps. In other words, the first binding weft 3'Bf and the second binding weft 4'Bs do not form knuckles that consecutively pass below three or more warps located on the lower surface side out of the warps located on the lower surface side. The knuckles formed on the lower surface side by the first binding weft 3'Bf and the second binding weft 4'Bs are each formed passing below two consecutive warps located on the lower surface side. Thereby, the part of the first binding weft 3'Bf and the part of the second binding weft 4'Bs that are exposed can be reduced such that the durability of the first binding weft 3'Bf and the second binding weft 4'Bs can be improved. Although the other first binding wefts (7'Bf, 11'Bf, 15'Bf, 19'Bf, and 23'Bf) and second binding wefts (8'Bs, 12'Bs, 16'Bs, 20'Bs, and 24'Bs) include those whose weaving position is shifted in the weft direction compared to that of the first binding weft 3'Bf and the second binding weft 4'Bs, the other first and second binding wefts have the same weaving pattern and exhibit the same function.

The first binding wefts (3'Bf, 7'B, 11'B, 15'Bf, 19'Bf, and 23'Bf) and the second binding wefts (4'Bs, 8'Bs, 12'Bs, 16'Bs, 20'Bs, and 24'Bs) are arranged being adjacent to each other in the warp direction in pairs. This allows the binding force for binding the upper surface side fabric and the lower surface side fabric to be increased.

A pair formed by a first binding weft and a second binding weft that are adjacent to each other forms knuckles for one upper surface side weft on the obverse surface of the upper surface side fabric. In other words, the number of knuckles formed by the pair formed by the first binding weft and the second binding weft that are adjacent to each other on the obverse surface of the upper surface side fabric is the same as the number of knuckles formed by one upper surface side weft on the obverse surface of the upper surface side fabric. This allows for suppression of a decrease in the surface properties of the upper surface side fabric.

The industrial fabric 60 is bound by the pairs of the first binding wefts and the second binding wefts and the pairs of the first binding warps and the second warps. Thus, the industrial fabric 60 can be bound with an appropriate binding force that can suppress internal wear of the upper surface side fabric and the lower surface side fabric. In addition to binding with the binding warps, binding with binding wefts allows for the setting of an appropriate binding force compared to simply increasing the number of binding warps.

Seventh Embodiment

Figure 15:
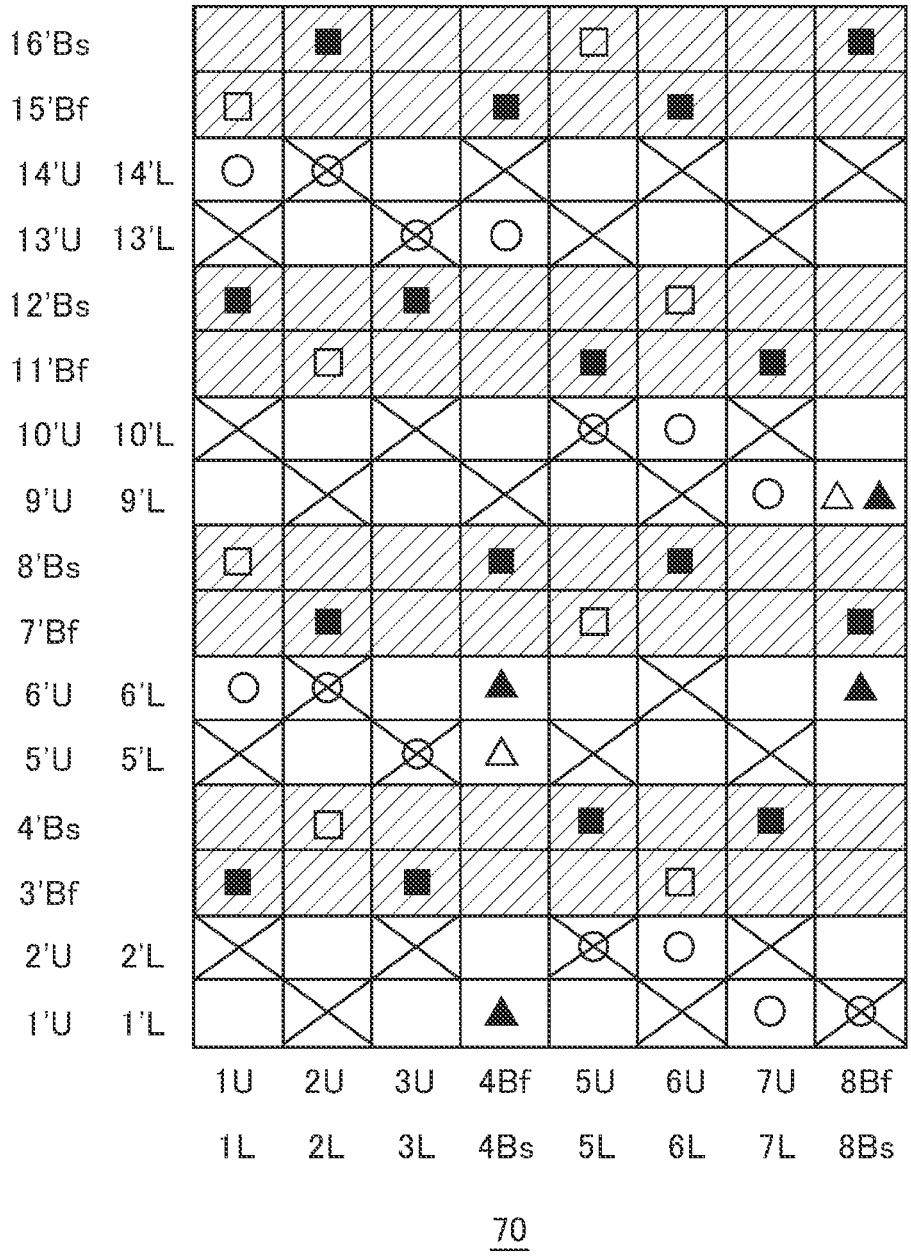
FIG. 15 is a design diagram showing a weave repeat of an industrial fabric according to the seventh embodiment.

FIG. 15 is a design diagram showing a weave repeat of an industrial fabric 70 according to the seventh embodiment. FIG. 16 is a cross-sectional view in the warp direction along warps in the design diagram shown in FIG. 15. FIG. 17 is a cross-sectional view in the weft direction along wefts in the design diagram shown in FIG. 15.

In an industrial fabric 70 according to the seventh embodiment shown in FIG. 15, an upper surface side fabric formed including upper surface side warps (1U to 3U and 5U to 7U) and upper surface side wefts (1'U, 2'U, 5'U, 6'U, 9'U, 10'U, 13'U, and 14'U) and a lower surface side fabric formed including lower surface side warps (1L to 3L and 5L to 7L) and lower surface side wefts (1'L, 2'L, 5'L, 6'L, 9'L, 10'L, 13'L, and 14'L) are bound to each other by the first binding warps (4Bf and 8Bf), the second binding warps (4Bs and 8Bs), the first binding wefts (3'Bf, 7'Bf, 11'Bf, and 15'Bf), and the second binding wefts (4'Bs, 8'Bs, 12'Bs, and 16'Bs). The first binding wefts and the second binding wefts are simply referred to as binding wefts when the binding wefts are not to be distinguished.

The first binding wefts (3'Bf, 7'Bf, 11'Bf, and 15'Bf) and the second binding wefts (4'Bs, 8'Bs, 12'Bs, and 16'Bs) bind the upper surface side fabric and the lower surface side fabric so as to form a weaving pattern for one upper surface side weft and are thus included in a weaving pattern of the upper surface side warps and the binding warps.

Figure 16A:
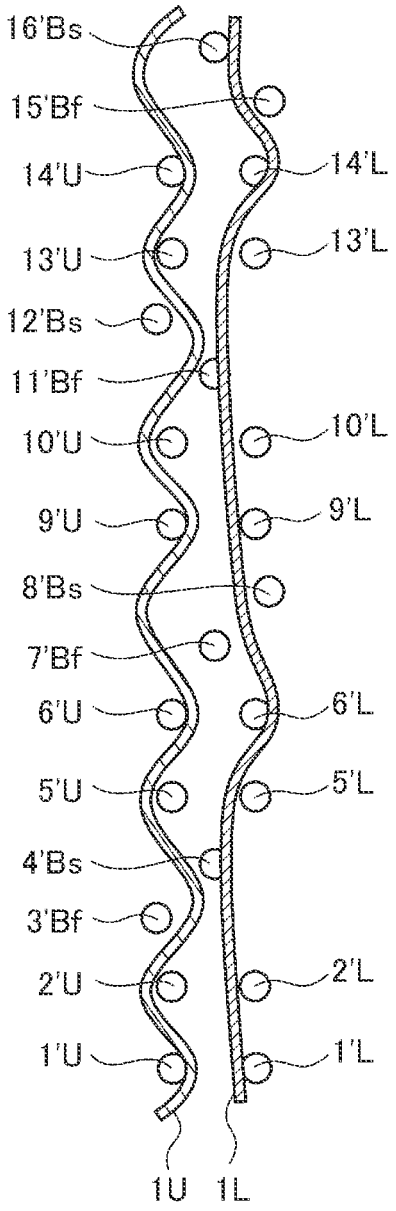
FIG. 16 is a cross-sectional view in the warp direction along warps in the design diagram shown in FIG. 15.

FIG. 16A shows a form in which a pair formed by the upper surface side warp 1U and the lower surface side warp 1L is interwoven with the upper and lower surface side wefts and the binding wefts. The upper surface side wefts, the lower surface side wefts, and the binding wefts shown in FIGS. 10A and 10B are arranged in the same manner. The upper surface side warp 1U and the lower surface side warp 1L are arranged facing each other vertically.

As shown in FIG. 16A, the upper surface side warp 1U is woven above and below the wefts located on the upper surface side that include the upper surface side wefts (1'U, 2'U, 5'U, 6'U, 9'U, 10'U, 13'U, and 14'U), the first binding wefts (3'Bf, 7'Bf, 11'Bf, and 15'Bf) and the second binding wefts (4'Bs, 8'Bs, 12'Bs, and 16'Bs) alternately one by one. The upper surface side warp 1U passes above the upper surface side wefts (2'U, 5'U, 10'U, and 13'U) and the binding wefts (7'Bf and 16'Bs) so as to form knuckles and passes below the upper surface side wefts (1'U, 6'U, 9'U, and 14'U) and the binding wefts (3'Bf and 12'Bs). The upper surface side warp 1U passes above the binding wefts (4'Bs, 7'Bf, 8'Bs, 11'Bf, 15'Bf, and 16'Bs) and passes below the binding wefts (3'Bf and 12'Bs).

Although the upper surface side warps (2U, 3U, and 5U to 7U) include those whose weaving position is shifted in the warp direction compared to the upper surface side warp 1U, the upper surface side warps have the same weaving pattern as that of the upper surface side warp 1U and are woven passing above and below the wefts located on the upper surface side alternately one by one. As described, the upper surface side warps (1U to 3U and 5U to 7U) have the same weaving pattern, form knuckles at constant intervals with respect to the wefts located on the upper surface side, and are interwoven alternately without destroying the obverse surface texture. Without being interwoven with the lower surface side wefts, the upper surface side warps are interwoven only with the upper surface side wefts and the binding wefts so as to form a part of the upper surface side fabric.

The lower surface side warp 1L passes below the lower surface side wefts (6'L and 14'L) so as to form knuckles, respectively, and passes above the lower surface side wefts (1'L, 2'L, 5'L, 9'L, 10'L, and 13'L). The lower surface side warp1L is woven passing alternately below one lower surface side weft and above three lower surface side wefts. The lower surface side warp 1L passes below the binding wefts (3'Bf, 4'Bs, 7'Bf, 11'Bf, 12'Bs, and 16'Bs) and passes above the binding wefts (8'Bs and 15'Bf).

Although the lower surface side warps (2L, 3L, and 5L to 7L) include those whose weaving position is shifted in the warp direction from that of the lower surface side warp 1L, the lower surface side warps have the same weaving pattern as that of the lower surface side warp 1L and are woven passing alternately below one lower surface side weft and above three lower surface side wefts. As described, without being interwoven with all the upper surface side wefts, the lower surface side warps (1L to 3L and 5L to 7L) are interwoven only with the lower surface side wefts and the binding wefts so as to form a part of the lower surface side fabric.

The upper surface side warps (1U to 3U and 5U to 7U) have a common weaving pattern of being woven above and below the wefts located on the upper surface side alternately one by one.

Further, the lower surface side warps (1L to 3L and 5L to 7L) each also have a common weaving pattern and have a weaving pattern in which the lower surface side warps are interwoven with the lower surface side wefts (1'L, 2'L, 5'L, 6'L, 9'L, 10'L, 13'L, and 14'L) while passing alternately below one of the lower surface side wefts and above three of the lower surface side wefts.

Figure 16B:
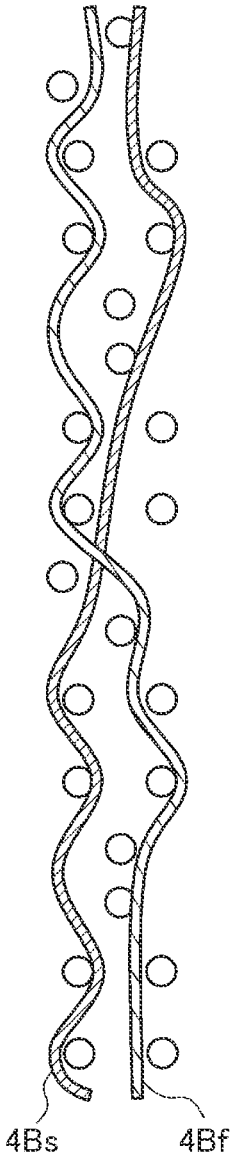

FIG. 16B shows a form in which a pair formed by the first binding warp 4Bf and the second binding warp 4Bs is interwoven with the upper and lower surface side wefts and the binding wefts. The first binding warp 4Bf and the second binding warp 4Bs form a pair facing each other vertically and intersect with each other due to binding.

The first binding warp 4Bf passes above the upper surface side wefts (1'U and 6'U) and the binding weft 3'Bf so as to form knuckles, respectively, and passes below the upper surface side wefts (2'U, 5'U, 9'U, 10'U, 13'U, and 14'U) and the binding wefts (8'Bs and 15'Bf). The first binding warp 4Bf passes below the lower surface side weft 13'L so as to form a knuckle and passes above the other lower surface side wefts (1'L, 2'L, 5'L, 6'L, 9'L, 10'L, and 14'L) and the binding wefts (3'Bf, 4'Bs, 7'Bf, 11'Bf, 12'Bs, and 16'Bs). The first binding warp 4Bf passes below the lower surface side weft 13'L so as to form one knuckle and passes above the wefts (1'U, 3'Bf, and 6'U) located on the upper surface side so as to form three knuckles.

The second binding warp 4Bs passes above the upper surface side wefts (9'U and 14'U) and the binding weft 11'Bf so as to form knuckles, respectively, and passes below the other upper surface side wefts (1'U, 2'U, 5'U, 6'U, 10'U, and 13'U) and the binding wefts (3'Bf, 4'Bs, 7'Bf, 8'Bs, and 15'Bf). The second binding warp 4Bs passes below the lower surface side weft 5'L so as to form a knuckle and passes above the other lower surface side wefts (1'L, 2'L, 6'L, 9'L, 10'L, 13'L, and 14'L) and the binding wefts (11'Bf, 12'Bs, and 16'Bs). The second binding warp 4Bs passes below the lower surface side weft 5'L so as to form one knuckle and passes above the wefts (9'U, 11'Bf, and 14'U) located on the upper surface side so as to form two knuckles.

The pair formed by the first binding warp 4Bf and the second binding warp 4Bs has a weaving pattern in which the pair is woven above and below the wefts alternately one by one that include the first binding wefts and the second binding wefts and that are located on the upper surface side. The pair formed by the first binding warp 4Bf and the second binding warp 4Bs has a weaving pattern in which the pair is interwoven with the lower surface side wefts while passing below one lower surface side weft and above three lower surface side wefts alternately.

As described, the pair formed by the first binding warp 4Bf and the second binding warp 4Bs has a common weaving pattern as that of the upper surface side warps and the lower surface side warps. Although the weaving position is shifted in the warp direction, the pair formed by the first binding warp 8Bf and the second binding warp 8Bs has the same weaving pattern as that of the pair formed by the first binding warp 4Bf and the second binding warp 4Bs and exhibits the same function.

The first binding warps (4Bf and 8Bf) and the second binding warps (4Bs and 8Bs) are interwoven with the upper surface side wefts so as to form an upper surface side fabric formed in a predetermined weaving pattern for each warp row. In other words, the upper surface side warps and the first and second binding warps form knuckles that are separated at constant intervals on the upper surface side fabric. This allows for suppression of a decrease in the surface properties of the upper surface side fabric.

The pair formed by the first binding warps (4Bf and 8Bf) and the second binding warps (4Bs and 8Bs) is interwoven with the lower surface side wefts so as to form a lower surface side fabric formed in a predetermined weaving pattern for each warp row. In other words, the lower surface side warps and the first and second binding warps form knuckles that are separated at constant intervals on the lower surface side fabric. This allows for suppression of a decrease in the surface properties of the lower surface side fabric.

Figure 17A:
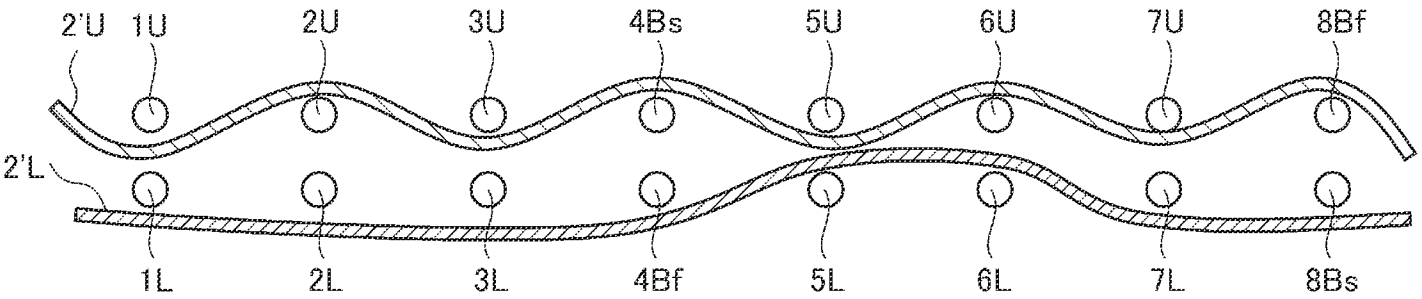
FIG. 17 is a cross-sectional view in the weft direction along wefts in the design diagram shown in FIG. 15.

FIG. 17A shows a form in which a pair formed by the upper surface side weft 2'U and the lower surface side weft 2'L is interwoven with the upper and lower surface side warps and the binding warps. As shown in FIG. 17A, the upper surface side weft 2'U is woven above and below the warps (1U to 3U, 4Bs, 5U to 7U, and 8Bf located on the upper surface side alternately one by one, passes above the warps (2U, 4Bs, 6U, and 8Bf) located on the upper surface side so as to form knuckles, respectively, and passes below the warps (1U, 3U, 5U, and 7U) located on the upper surface side. The other upper surface side wefts (1'U, 5'U, 6'U, 9'U, 10'U, 13'U, and 14'U) have the same weaving pattern as that of the upper surface side weft 2'U and are woven above and below the warps located on the upper surface side alternately one by one.

The lower surface side weft 2'L passes below six warps (1L to 3L, 4Bf, 7L, and 8Bs) located on the lower surface side so as to form a long knuckle and passes above two lower surface side warps (5L and 6L). Although the other lower surface side wefts (1'L, 5'L, 6'L, 9'L, 10'L, 13'L, and 14'L) include those whose weaving position is shifted in the weft direction from that of the lower surface side weft 2'L, the other lower surface side wefts have the same weaving pattern as that of the lower surface side weft 2'L, pass below six warps located on the lower surface side so as to form a long knuckle, and pass above two warps located on the lower surface side.

Figure 17B:
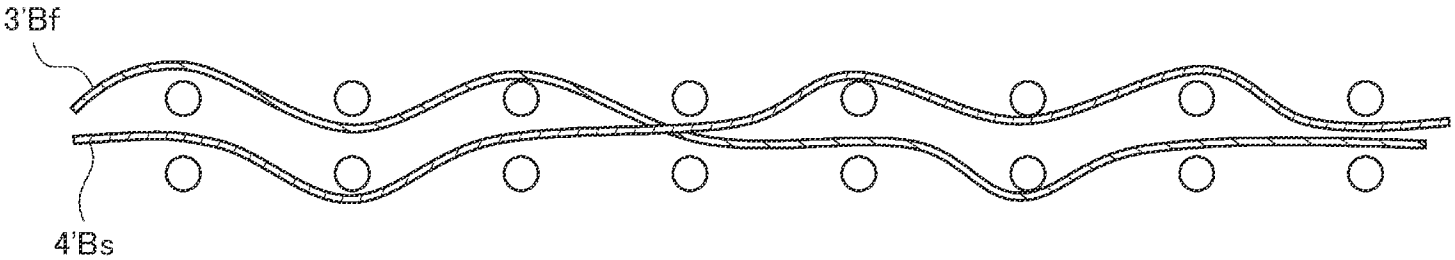

FIG. 17B shows a form in which the first binding weft 3'Bf and the second binding weft 4'Bs are interwoven with the upper and lower surface side warps and the binding warps. The arrangement of warps in FIG. 17B is the same as that shown in FIG. 17A.

The first binding weft 3'Bf passes above the upper surface side warps (1U and 3U) so as to form knuckles, respectively, and passes below the other warps (2U, 4Bs, 5U to 7U, and 8Bf) located on the upper surface side. The first binding weft 3'Bf passes below one warp 6L located on the lower surface side so as to form a knuckle and passes above the other warps (1L to 3L, 4Bf, 5L, 7L, and 8Bs) located on the lower surface side. That is, the first binding weft 3'Bf forms two knuckles on the upper surface side obverse surface texture and one knuckle on the lower surface side obverse surface texture.

The second binding weft 4'Bs passes above the upper surface side warps (5U and 7U) so as to form knuckles, respectively, and passes below the other warps (1U to 3U, 4Bs, 6U, and 8Bf) located on the upper surface side. The second binding weft 4'Bs passes below the warp 2L located on the lower surface side so as to form a knuckle and passes above the other warps (1L, 3L, 4Bf, 5L to 7L, and 8Bs) located on the lower surface side. That is, the second binding weft 4'Bs forms two knuckles on the upper surface side obverse surface texture and one knuckle on the lower surface side obverse surface texture, just like the first binding weft 3'Bf.

The first binding weft 3'Bf and the second binding weft 4'Bs form knuckles that consecutively pass above two or less upper surface side warps out of the warps located on the upper surface side. In other words, the first binding weft 3'Bf and the second binding weft 4'Bs do not form knuckles that consecutively pass above three or more upper surface side warps out of the upper surface side warps. The knuckles formed on the upper surface side by the first binding weft 3'Bf and the second binding weft 4'Bs are each formed passing above only one upper surface side warp.

The first binding weft 3'Bf and the second binding weft 4'Bs form knuckles that consecutively pass below two or less lower surface side warps out of the lower surface side warps. In other words, the first binding weft 3'Bf and the second binding weft 4'Bs do not form knuckles that consecutively pass below three or more lower surface side warps out of the lower surface side warps. The knuckles formed on the lower surface side by the first binding weft 3'Bf and the second binding weft 4'Bs are each formed passing below one lower surface side warp. Thereby, the part of the first binding weft 3'Bf and the part of the second binding weft 4'Bs that are exposed can be reduced so as to suppress wear such that the durability of the first binding weft 3'Bf and the second binding weft 4'Bs can be improved. Although the weaving position is shifted in the weft direction compared to that of the first binding weft 3'Bf and the second binding weft 4'Bs, the other first binding wefts (7'B, 11'B, and 15'Bf) and second binding wefts (8'Bs, 12'Bs, and 16'Bs) have the same weaving pattern and exhibit the same function.

The first binding warps and the second binding warps are arranged in pairs being adjacent to each other in the warp direction. A pair formed by a first binding weft and a second binding weft that are adjacent to each other forms knuckles for one upper surface side weft on the obverse surface of the upper surface side fabric. In other words, the number of knuckles formed by the pair formed by the first binding weft and the second binding weft that are adjacent to each other on the obverse surface of the upper surface side fabric is the same as the number of knuckles formed by one upper surface side weft on the obverse surface of the upper surface side fabric. This allows for suppression of a decrease in the surface properties of the upper surface side fabric.

Eighth Embodiment

Figure 18:
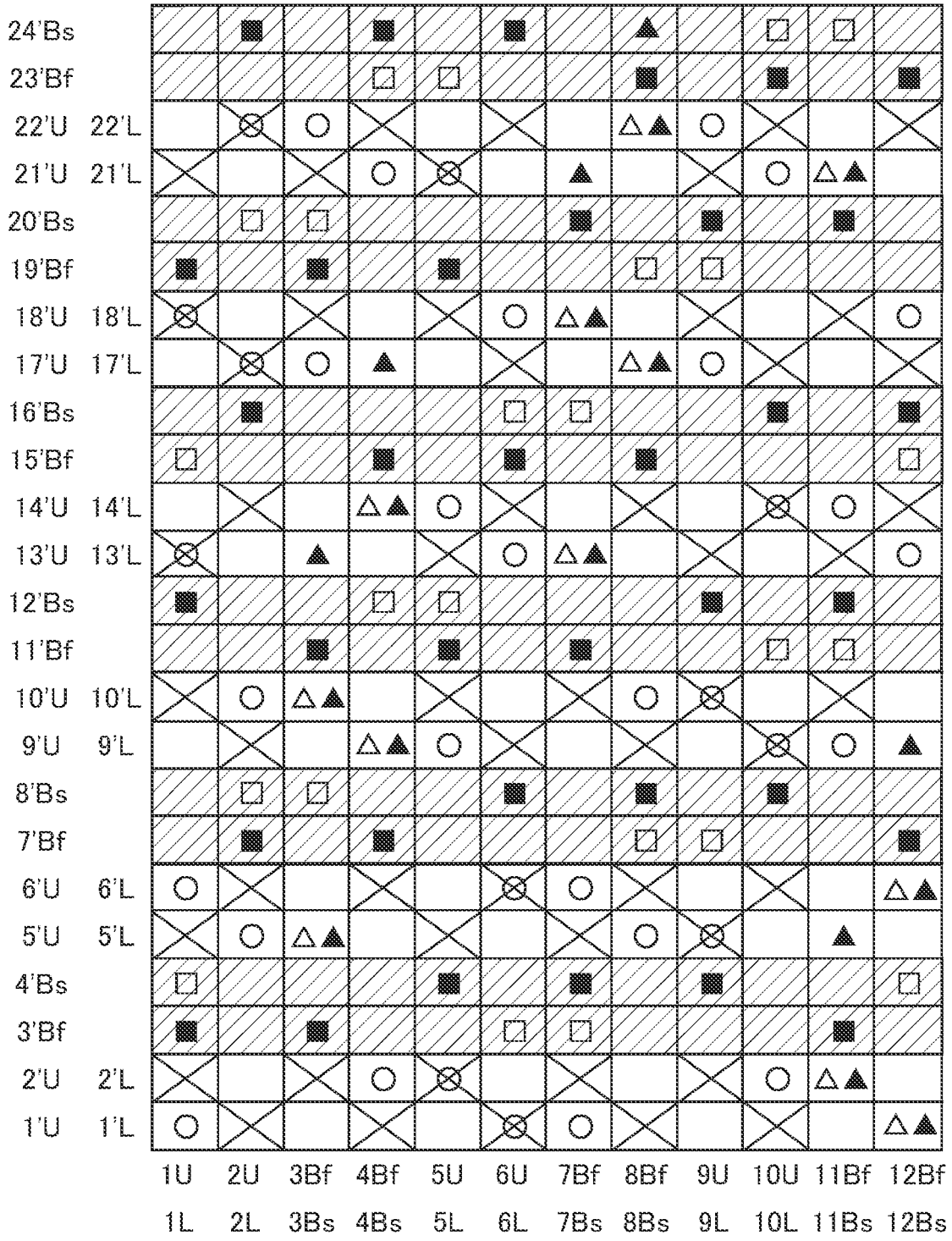
FIG. 18 is a design diagram showing a weave repeat of an industrial fabric according to the eighth embodiment.

FIG. 18 is a design diagram showing a weave repeat of an industrial fabric 80 according to the eighth embodiment. Compared to the industrial fabric 60 shown in FIG. 12, the differences lie in that the number of the pairs of the first binding warps and the second binding warps is larger and in that the first binding warps and the second binding warps are adjacent to each other in the pairs of the first binding warps and the second binding warps while the first binding warps and the second binding warps are not adjacent to each other in the pairs of the first binding warps and the second binding warps in the industrial fabric 60 shown in FIG. 12. This allows the binding force for binding the upper surface side fabric and the lower surface side fabric to be increased.

An industrial fabric according to each of the above embodiments may be subjected to the following processing. For example, in order to improve the surface smoothness, the obverse surface side of the industrial fabric may be polished in the range of 0.02 to 0.05 mm. In particular, the obverse surface side may be polished by 0.02 mm or 0.03 mm.

Further, in order to suppress the fraying of yarns at the ends of the mesh (industrial fabric), the range of 5 mm to 30 mm, particularly the range of 5 mm, 10 mm, or 20 mm, from the ends of the mesh may be coated with a polyurethane resin for reinforcement. The coating of the mesh ends may be coated on one or both sides. The resin may be hot melt polyurethane.

In order to improve the wear resistance of a mesh end, the mesh may be coated in the range of 20 mm to 500 mm (particularly 25, 50, 75, 100, 150, 250, 300, 350, or 400 mm) from the mesh end with three to sixteen (particularly three, four, seven, eight, ten, twelve, fifteen, or sixteen) strips of resin of a width of about 7 mm over the entire length. The plurality of above-mentioned strips of polyurethane resin may be applied to both ends of the mesh or only to one side. The resin may be hot melt polyurethane.

The entire mesh may be coated with resin in order to improve the antifouling performance. In order to allow for the trimming of the paper making width near the mesh end, the mesh may be coated in the range of 10 mm to 500 mm (particularly 10, 15, 20, 25, 30, 40, 50, 75, 100, 150, 200, 250, 300, 350, or 400 mm) from the mesh end with one strip of resin of a width of about 3, 5, 7, 10, 15, or 20 mm over the entire length. The above-mentioned resin may be applied to both ends of the mesh or only to one side. The resin may be polyurethane and may be hot melt. Further, the mesh may have lines of about 25 mm or 50 mm in width across the entire width so that the line bending of the mesh can be seen during use.

The following is a list of preferred element ranges for an industrial fabric. The warp diameter is preferably 0.10 mm to 1.0 mm, more preferably 0.1 mm to 0.5 mm, and particularly preferably 0.11 mm to 0.35 mm, where the warp includes an upper surface side warp, a lower surface side warp, a first binding warp, a second binding warp, and a third binding warp. The diameter of the lower surface side warps may be the same as the diameter of the upper surface side warps or, alternatively, may be set 1.1 to 1.2 times the diameter of the upper surface side warps. The weft diameter is preferably 0.10 mm to 1.0 mm, more preferably 0.12 mm to 0.6 mm, and particularly preferably 0.12 mm to 0.55 mm. The diameter of the lower surface side wefts is desirably larger than the diameter of the upper surface side warps and may be 1.1 to 3.0 times and more preferably 1.2 to 2.0 times the diameter of the upper surface side wefts.

The upper surface side wefts may be composed of only PET wires, only polyamide wires, or PET wires and polyamide wires that are alternately interwoven. The lower surface side wefts may be composed of only PET wires or only polyamide wires or may be composed of PET wires and polyamide wires that are alternately interwoven. Also, in order to reduce the driving load of the machine, low-friction yarns may be woven with the lower surface side wefts.

The ratio of the number of upper surface side wefts to the number of lower surface side wefts may be 1:1, 2:1, 3:1, 4:1, 3:2, 4:3, 5:2, 5:3, or 5:4. The air permeability is preferably 100 $cm^3/cm^2/s$ to 600 $cm^3/cm^2/s$ and more preferably 120 $cm^3/cm^2/s$ to 300 $cm^3/cm^2/s$.

The mesh thickness is preferably 0.3 mm to 3.0 mm, more preferably 0.5 mm to 2.5 mm, and particularly preferably 0.5 mm to 1.0 mm. The usage applications include mainly usage as a papermaking or nonwoven fabric belt and may include particularly usage as a papermaking dewatering belt or a spunbond nonwoven fabric conveying belt.

The cross-sectional shape of the warps and wefts according to each of the above-mentioned embodiments is not limited to a circular shape, and yarns having a quadrangular shape, a star shape, etc., and yarns having an elliptical shape, a hollow shape, a sheath-core structure shape, etc., can be used. In particular, by making the cross-sectional shape of the lower warps have a square shape, a rectangular shape, or an elliptical shape, the cross-sectional area of the yarns can be increased, and elongation resistance and rigidity can thus be improved.

Further, the yarn material can be freely selected as long as the yarn satisfies the desired characteristics, and polyethylene terephthalate, polyester, polyamide, polyphenylene sulfide, polyvinylidene fluoride, polypropylene, aramid, polyether ether ketone, polyethylene naphthalate, polytetrafluoroethylene, cotton, wool, metals, thermoplastic polyurethane, thermoplastic elastomers, etc., can be used. Needless to say, yarns prepared from a copolymer and yarns prepared by blending or adding various substances to such a material may be used according to the purpose. In general, polyester monofilaments having rigidity and excellent dimensional stability are preferably used as yarns constituting industrial fabrics.

The number of warp shafts is preferably 4 shafts to 8 shafts, 10 shafts, 12 shafts, 14 shafts, 15 shafts, 16 shafts, 18 shafts, 20 shafts, 24 shafts, 28 shafts, 30 shafts, 32 shafts, 36 shafts, 40 shafts, 44 shafts, or 48 shafts. The number of warp shafts is preferably a multiple of four, a multiple of five, or a multiple of seven, particularly. Further, the number of weft shafts is preferably 4 shafts to 8 shafts, 10 shafts, 12 shafts, 14 shafts, 15 shafts, 16 shafts, 18 shafts, 20 shafts, 24 shafts, 28 shafts, 30 shafts, 32 shafts, 36 shafts, 40 shafts, 44 shafts, or 48 shafts. The number of weft shafts is preferably a multiple of two, a multiple of five, or a multiple of seven, particularly.

The warp texture of the obverse surface may be plain weave, twill weave, satin weave, broken satin weave, sateen weave, 2/2 weave, or herringbone pattern weave. Further, the warp texture of the reverse surface may be plain weave, twill weave, satin weave, broken satin weave, sateen weave, 2/2 weave, or herringbone pattern weave. Further, texture in which two warps form knuckles on the lower side of lower wefts at the same position just like rib weave and 1/2 or 1/4 weave may be used.

The number of lower surface side weft is preferably 1'L. Further, the number of upper surface side weft is preferably 1'U.

Further, the number of lower surface side warp 1L. Further, the number of upper surface side warp preferably 1U. Further, the number of industrial fabric preferably 10.

What is claimed is:

1. An industrial fabric in which an upper surface side fabric and a lower surface side fabric are bound, wherein the upper surface side fabric and the lower surface side fabric are formed by interweaving warps and wefts, wherein the wefts include:

binding wefts that bind the upper surface side fabric and the lower surface side fabric;

upper surface side wefts that form a part of the upper surface side fabric; and lower surface side wefts that form a part of the lower surface side fabric;

wherein the warps include:

binding warps that bind the upper surface side fabric and the lower surface side fabric;

upper surface side warps that are interwoven with the upper surface side wefts without being interwoven with the lower surface side wefts so as to form a part of the upper surface side fabric; and lower surface side warps that are interwoven with the lower surface side wefts without being interwoven with the upper surface side wefts so as to form a part of the lower surface side fabric, wherein each of the upper surface side warps arranged vertically with the lower surface side warps so as to form pairs has a common weaving pattern excluding the binding wefts, wherein the binding warps constitute at least one of two of the warps vertically arranged forming pairs, wherein in the pairs formed by the binding warps and the warps arranged vertically with the binding warps, the binding warps and the warps complement each other so as to form a weaving pattern for one upper surface side warp and a weaving pattern for one lower surface side warp, respectively, wherein the upper surface side warps and the binding warps are interwoven with the upper surface side wefts so as to form the upper surface side fabric formed in a predetermined weaving pattern for each warp row, wherein the lower surface side warps and the binding warps are interwoven with the lower surface side wefts so as to form the lower surface side fabric formed in a predetermined weaving pattern for each warp row, and wherein the binding wefts form knuckles that pass above two or less of the upper surface side warps consecutively and are not adjacent to one another in the warp direction.

2. An industrial fabric in which an upper surface side fabric and a lower surface side fabric are bound, wherein the upper surface side fabric and the lower surface side fabric are formed by interweaving warps and wefts, wherein the wefts include:

binding wefts that bind the upper surface side fabric and the lower surface side fabric;

upper surface side wefts that form a part of the upper surface side fabric; and lower surface side wefts that form a part of the lower surface side fabric;

wherein the warps include:

binding warps that bind the upper surface side fabric and the lower surface side fabric;

upper surface side warps that are interwoven with the upper surface side wefts without being interwoven with the lower surface side wefts so as to form a part of the upper surface side fabric; and lower surface side warps that are interwoven with the lower surface side wefts without being interwoven with the upper surface side wefts so as to form a part of the lower surface side fabric, wherein the binding warps constitute at least one of two of the warps vertically arranged forming pairs, wherein in the pairs formed by the binding warps and the warps arranged vertically with the binding warps, the binding warps and the warps complement each other so as to form a weaving pattern for one upper surface side warp and a weaving pattern for one lower surface side warp, respectively, wherein the upper surface side warps and the binding warps are interwoven with the upper surface side wefts and the binding wefts so as to form the upper surface side fabric formed in a predetermined weaving pattern for each warp row, wherein the lower surface side warps and the binding warps are interwoven with the lower surface side wefts so as to form the lower surface side fabric formed in a predetermined weaving pattern for each warp row, wherein the binding wefts have a first binding weft and a second binding weft that are arranged being adjacent to each other in a pair, wherein in the pair formed by the first binding weft and the second binding weft that are adjacent to each other, the first binding weft and the second binding weft complement each other so as to form a weaving pattern for one upper surface side weft on a obverse surface of the upper surface side fabric, and wherein the first binding weft and the second binding weft each form knuckles that pass above two or less of the upper surface side warps consecutively, wherein the upper surface side warps include an upper surface side collapsing yarn that vertically forms a pair with the binding warps, and wherein the upper surface side collapsing yarn passes below the upper surface side wefts and collapses a part of the upper surface side obverse surface texture at a position where the binding warps form knuckles on the upper surface side wefts.

3. The industrial fabric according to claim 1, wherein the binding warps have a first binding warp and a second binding warp vertically arranged forming a pair.

4. The industrial fabric according to claim 1, wherein the upper surface side warps include an upper surface side collapsing yarn that vertically forms a pair with the binding warps, and wherein the upper surface side collapsing yarn passes below the upper surface side wefts and collapses a part of the upper surface side obverse surface texture at a position where the binding warps form knuckles on the upper surface side wefts.

5. The industrial fabric according to claim 1, wherein the binding wefts have a diameter smaller than that of the lower surface side wefts.

6. The industrial fabric according to claim 1, wherein a diameter of the upper surface side warps and a diameter of the binding warps are the same.

7. The industrial fabric according to claim 1, wherein the binding wefts form knuckles that pass below two or less of the lower surface side warps consecutively.

8. The industrial fabric according to claim 2, wherein the binding warps have a first binding warp and a second binding warp vertically arranged forming a pair.

9. The industrial fabric according to claim 2, wherein the binding wefts have a diameter smaller than that of the lower surface side wefts.

10. The industrial fabric according to claim 2, wherein a diameter of the upper surface side warps and a diameter of the binding warps are the same.

11. The industrial fabric according to claim 2, wherein the binding wefts form knuckles that pass below two or less of the lower surface side warps consecutively.

* * * * *